US009164423B2

(12) United States Patent
Mochizuki et al.

(10) Patent No.: US 9,164,423 B2
(45) Date of Patent: Oct. 20, 2015

(54) DEVELOPER REPLENISHMENT CONTAINER ACCOMMODATING APPARATUS, DEVELOPER REPLENISHMENT CONTAINER, AND IMAGE FORMING APPARATUS

(71) Applicants: CANON FINETECH INC., Misato-shi, Saitama-ken (JP); CANON KABUSHIKI KAISHA, Tokyo (JP)

(72) Inventors: Kazuhiro Mochizuki, Misato (JP); Akira Masuda, Tachikawa (JP); Yutaka Ban, Tokyo (JP); Nobuo Nakajima, Higashi Matsuyama (JP)

(73) Assignees: CANON FINETECH INC., Misato-shi (JP); CANON KABUSHIKI KAISHA, Tokyo (JP)

( * ) Notice: Subject to any disclaimer, the term of this patent is extended or adjusted under 35 U.S.C. 154(b) by 36 days.

(21) Appl. No.: 13/681,920

(22) Filed: Nov. 20, 2012

(65) Prior Publication Data

US 2013/0156470 A1 Jun. 20, 2013

(30) Foreign Application Priority Data

Dec. 16, 2011 (JP) ..... 2011-276318

(51) Int. Cl.
*G03G 15/08* (2006.01)

(52) U.S. Cl.
CPC ..... *G03G 15/0867* (2013.01); *G03G 15/0872* (2013.01); *G03G 15/0886* (2013.01)

(58) Field of Classification Search
CPC ..... G03G 2215/0665; G03G 2215/0668; G03G 15/0837; G03G 2221/1654
See application file for complete search history.

(56) References Cited

U.S. PATENT DOCUMENTS 6,118,951 A * 9/2000 Kato et al. ..... 399/27
6,952,549 B2 10/2005 Kato et al.
7,088,942 B2 * 8/2006 Minagawa ..... 399/258
7,110,709 B2 9/2006 Kato et al.

(Continued)

FOREIGN PATENT DOCUMENTS

JP 10-260574 A 9/1998
JP 2003-345112 A 12/2003

OTHER PUBLICATIONS

Japanese Office Action dated May 27, 2014, in related Japanese Patent Application No. 2011-276318.

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

A developer replenishment container accommodating assembly, in which a developer replenishment container is removably put in a main body of an accommodating apparatus, replenishes a developer while rotating the developer replenishment container and includes a holding portion provided on the main body and configured to hold the developer replenishment container put in the main body of the accommodating apparatus in a replenishment position for replenishing the developer, and an engaging portion configured to engage with the developer replenishment container when it is positioned in the main assembly. In addition, a biasing member is configured to bias the engaging portion in a predetermined direction so that the developer replenishment container rotating while held by the holding portion is pressed against the holding portion by the biased engaging portion.

15 Claims, 25 Drawing Sheets

(56) References Cited

U.S. PATENT DOCUMENTS

| | | | | |
|---|---|---|---|---|
| 7,242,893 | B2 * | 7/2007 | Murakami et al. | 399/262 |
| 2002/0025195 | A1 * | 2/2002 | Iwata et al. | 399/258 |
| 2004/0009016 | A1 | 1/2004 | Kato et al. | |
| 2005/0191094 | A1 * | 9/2005 | Kato et al. | 399/260 |
| 2011/0058857 | A1 * | 3/2011 | Hori et al. | 399/262 |
| 2011/0236076 | A1 * | 9/2011 | Fujii | 399/262 |

* cited by examiner

DEVELOPER REPLENISHMENT CONTAINER ACCOMMODATING APPARATUS, DEVELOPER REPLENISHMENT CONTAINER, AND IMAGE FORMING APPARATUS

BACKGROUND OF THE INVENTION

1. Field of the Invention

The present invention relates to a developer replenishment container accommodating apparatus, a developer replenishment container, and an image forming apparatus, and in particular, to a configuration for suppressing a vibration when replenishing a developer.

2. Description of the Related Art

In a conventional electrophotographic image forming apparatus such as a copy machine and a printer, a fine powder developer (toner) is used as a developer. When the developer of the electrophotographic image forming apparatus main body is consumed, the developer is replenished to the image forming apparatus main body by using a developer replenishment container (toner replenishment container). Because the developer is a considerably fine powder, when replenishing the developer, the developer replenishment container is kept in the image forming apparatus main body so that the developer is not scattered, and the developer is discharged through a small opening little by little (such a system is known as disclosed in Japanese Patent Application Laid-Open No. 2003-345112).

FIG. 27 is a perspective view of a developer replenishment container accommodating apparatus 400 provided in the image forming apparatus main body. The developer replenishment container accommodating apparatus (hereinafter referred to as an "accommodating apparatus") 400 includes a driving portion 22 that is coupled to a toner bottle as a developer replenishment container and drives the replenishment container to rotate. The driving portion 22 includes an open/close control member 21 that is driven to rotate by a driving motor portion 22*a* including a driving motor (not shown).

FIGS. 28A, 28B, 29A, 29B, 30A, and 30B are diagrams illustrating states of the accommodating apparatus 400 and a toner bottle 1 when the toner bottle 1 is put (accommodated) in the accommodating apparatus 400. FIG. 28A is a diagram illustrating a state in which an operation of putting the toner bottle 1 in the accommodating apparatus 400 is started. In this state, i.e., when the toner bottle 1 is in a position illustrated in FIG. 28A, the toner bottle 1 is not secured to the accommodating apparatus 400, and therefore, a user can mount the toner bottle 1 and remove the toner bottle 1 from the accommodating apparatus 400.

A cylindrical discharging portion 1*e* for discharging a developer (not shown) is provided on one tip end surface of the toner bottle 1, and an opening 1*a* of the discharging portion 1*e* is sealed by a sealing member 2. A release protrusion 4 that is elastically bent is provided on a proximal portion of the sealing member 2, and an engaging protrusion 3 that is elastically bent integrally with the release protrusion 4 is provided on a distal side of the sealing member 2.

FIG. 28B is a diagram illustrating a state in which the toner bottle 1 starts to be put in the accommodating apparatus 400 by a user pushing the toner bottle 1 in a direction indicated by the arrow "a". At this time, the sealing member 2 is inserted into the open/close control member 21 up to the release protrusion 4 provided on the proximal portion. At this time, the release protrusion 4 is pressed in an inner side direction by an inner circumferential surface of the open/close control member 21 and elastically bent in a direction indicated by the arrow "d", and at the same time, the engaging protrusion 3 is also bent toward the inner side. Therefore, the engaging protrusion 3 and the open/close control member 21 are in a state in which they are not engaged with each other. Further, when the sealing member is moved to this position, a positioning member 30 provided on the accommodating apparatus 400 side is engaged with a locking groove 1*d* formed in a side surface of a main body of the toner bottle 1, and hence a container main body 1*c* of the toner bottle 1 is locked to the accommodating apparatus 400.

When an operation of closing a replacement cover (not shown) is then started, along with a movement of the replacement cover, as illustrated in FIG. 29A, the open/close control member 21 is retracted in the direction indicated by the arrow "a". With this operation, the release protrusion 4 of the sealing member 2 is recovered from a pressed state, and accordingly the engaging protrusion 3 is elastically locked (stopped) into a locking hole (not shown) provided in the open/close control member 21. Further after that, when the replacement cover is closed, the open/close control member 21 is further retracted in the direction indicated by the arrow "a" keeping in a state of being engaged with the sealing member 2. With this operation, as illustrated in FIG. 29B, the sealing member 2 is separated from the toner bottle 1 so that the opening 1*a* is opened and the developer can be replenished.

When the driving motor portion 22*a* is driven in this state, the open/close control member 21 rotates, and the sealing member 2 engaged with the open/close control member 21 is rotated with the rotation of the open/close control member 21. The rotation of the sealing member 2 is transferred to a rotation driving portion 1*b* so that the container main body 1*c* is rotated. That is, the sealing member 2 has a function of sealing the opening 1*a*, a function of receiving a rotational driving force from the accommodating apparatus 400, and a function of transferring the rotational driving force to the toner bottle 1.

By the rotation of the toner bottle 1 via the sealing member 2 in the above-mentioned manner, the developer contained in the toner bottle 1 is sequentially discharged through the opening 1*a* and received in a hopper 24 that is a temporary developer accommodating container. The hopper 24 includes an agitating member 25 and a screw member 26, and the developer discharged from the toner bottle 1 is dropped to the hopper 24 by gravity and agitated by the agitating member 25.

The agitating member 25 is rotated in a direction indicated by the arrow "c" by a driving mechanism (not shown) so that the developer is moved to the screw member 26 by gravity. The screw member 26 is configured to convey the developer by a driving mechanism (not shown) in an axial direction, i.e., from the back to the front in a direction orthogonal to the cross-sectional view of FIG. 29B. Thus, when the screw member 26 is rotated, the developer is conveyed through a developer discharge port (not shown) of the hopper 24 to a developing device so that replenishment of the developer is performed.

When the replenishment of the developer is completed, the replacement cover is opened. When the replacement cover is opened, the open/close control member 21 moves from the position illustrated in FIG. 29B in a direction indicated by the arrow "b" illustrated in FIG. 29A. At this time, because the toner bottle 1 is locked to the accommodating apparatus 400 by the positioning member 30 with a predetermined biasing force, when the open/close control member 21 moves in this manner, the sealing member 2 is pushed into to seal the opening 1*a* of the toner bottle 1. At the same time, the release protrusion 4 is pressed toward the inner side by the inner circumferential surface of the open/close control member 21 and elastically deformed and bent in the direction indicated by the arrow "d". Accordingly, the engaging protrusion 3 is displaced toward the inner side so that the engagement of the engaging protrusion 3 and the open/close control member 21 is released, resulting in a state illustrated in FIG. 28B.

As a result, in this state, the toner bottle 1 can be pulled out of the accommodating apparatus 400, and the toner bottle 1 can be pulled out when the user pulls the toner bottle 1 with a force stronger than a maintaining force of a biasing member 31 described later, which is illustrated in FIG. 30A, for biasing the positioning member 30. That is, the putting of the toner bottle 1 in a replenishable position, the release of the toner bottle 1, and the removal of the bottle can be performed by a reciprocating operation of the toner bottle 1 and the open/close control member 21 in the directions indicated by the arrows "a" and "b" that are the rotational axis direction of the toner bottle and a combination thereof.

By the way, the positioning member 30 is protruded in a retractable manner to an insertion portion 400*a* into which an end portion of the toner bottle 1 is inserted, as illustrated in FIG. 30A. As illustrated in FIG. 30B, the positioning member 30 includes a first tapered portion 30*a* that is inclined downward along a push-in direction and a second tapered portion 30*b* that is located on a downstream side of the first tapered portion 30*a* in the push-in direction and inclined upward along the push-in direction. Further, the positioning member 30 is biased in a direction of protruding into the insertion portion 400*a* by the biasing member 31 illustrated in FIG. 30A.

When putting the toner bottle 1 in the accommodating apparatus 400, a locking piece 1*g* that is vertically formed on the discharging portion 1*e* as illustrated in FIG. 28A and forms a side wall surface of the locking groove 1*d* on the downstream side in the push-in direction first abuts on the first tapered portion 30*a* of the positioning member 30. After that, when the toner bottle 1 is further pushed in, the locking piece 1*g* passes the positioning member 30 along the first tapered portion 30*a* while causing the positioning member 30 to be retracted from the insertion portion 400*a* against the biasing force of the biasing member 31. When the locking piece 1*g* passes the first tapered portion 30*a* and moves along the second tapered portion 30*b*, the positioning member 30 is fitted into the locking groove 1*d* by the biasing force of the biasing member 31.

In this manner, when putting the toner bottle 1 in the accommodating apparatus 400, the positioning member 30 is pressed by the locking piece 1*g* so as to be retracted from the insertion portion 400*a*, and then when the locking piece 1*g* has passed the positioning member 30, the positioning member 30 is protruded to the insertion portion 400*a* to be fitted into the locking groove 1*d*, as illustrated in FIG. 28B. With this configuration, when the user pushes the toner bottle 1 into the accommodating apparatus 400, a tension applied by the biasing member 31 is exerted on the user.

However, in the case of using the conventional accommodating apparatus and the toner bottle having the above-mentioned configuration, when fixing the position of the toner bottle 1 with respect to the accommodating apparatus 400, looseness may occur between the locking groove 1*d* and the positioning member 30. If such looseness occurs, when the toner bottle 1 is rotated to replenish the developer, the toner bottle 1 is rotated while causing a vibration due to the looseness.

When the toner bottle 1 is vibrated in this manner, the vibration may be transferred to an image forming portion, possibly generating an uneven image.

SUMMARY OF THE INVENTION

In view of the above-mentioned circumstances, the present invention provides a developer replenishment container accommodating apparatus, a developer replenishment container, and an image forming apparatus, which suppress a vibration at the time of replenishing a developer.

According to an exemplary embodiment of the present invention, there is provided a developer replenishment container accommodating apparatus in which a developer replenishment container is removably put in a main body of the accommodating apparatus, which replenishes a developer while rotating the developer replenishment container, the accommodating apparatus including: a holding portion provided on the main body of the accommodating apparatus and configured to hold the developer replenishment container put in the main body of the accommodating apparatus in a replenishment position for replenishing the developer; and a pressing portion configure to press the developer replenishment container put in the main body of the accommodating apparatus toward an upstream side in a push-in direction in which the developer replenishment container is pushed in the main body of the accommodating apparatus, wherein, when the developer replenishment container is put in the main body of the accommodating apparatus, the developer replenishment container is secured while being biased and pressed against the holding portion by the pressing portion.

Further, according to an exemplary embodiment of the present invention, there is provided a developer replenishment container which is removably put in a main body of a developer replenishment container accommodating apparatus and replenishes a developer while being rotated by the accommodating apparatus, the developer replenishment container including: a portion to be engaged which is disengageably engaged with a holding portion provided on the main body of the accommodating apparatus so that the developer replenishment container is held in a replenishment position for replenishing the developer when the developer replenishment container is put in the main body of the accommodating apparatus; and a portion to be pressed which is pressed by a pressing portion provided on the main body of the accommodating apparatus, wherein, when the developer replenishment container is put in the main body of the accommodating apparatus and is being rotated, the developer replenishment container is secured in a manner that the portion to be engaged is pressed against the holding portion by the portion to be pressed being pressed by the pressing portion.

According to the present invention, when the developer replenishment container is put in the main body of the accommodating apparatus, the developer replenishment container is secured while being biased and pressed against the holding portion by the pressing portion. Therefore, the vibration at the time of replenishing the developer can be suppressed, and occurrence of an uneven image can be reduced.

Further features of the present invention will become apparent from the following description of exemplary embodiments with reference to the attached drawings.

DESCRIPTION OF THE EMBODIMENTS

Figure 1:
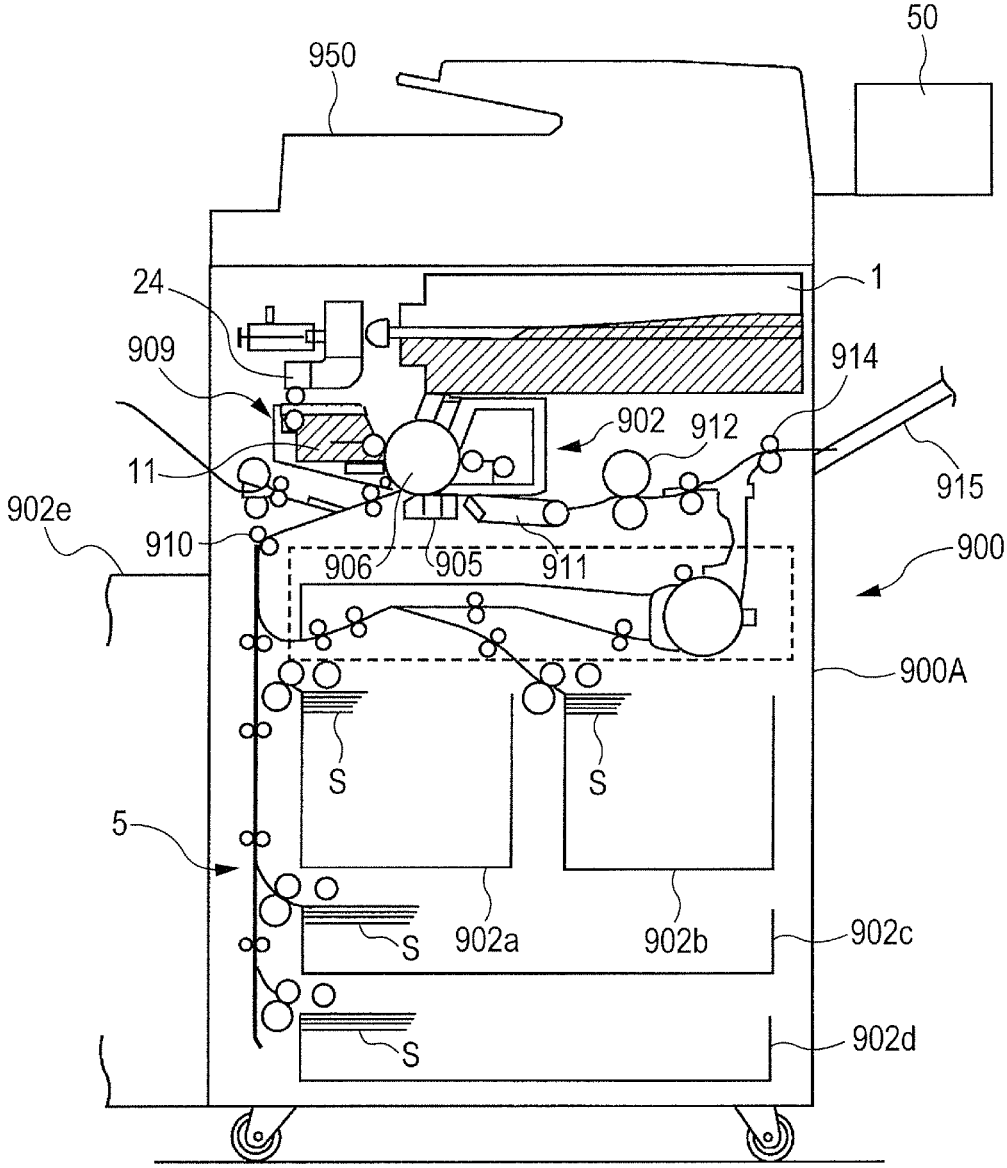
FIG. 1 is a diagram illustrating a configuration of an image forming apparatus including a developer replenishment container accommodating apparatus according to a first embodiment of the present invention.

Exemplary embodiments of the present invention will be described in detail below with reference to the accompanying drawings. FIG. 1 is a diagram illustrating a configuration of an image forming apparatus including a developer replenishment container accommodating apparatus according to a first embodiment of the present invention. As illustrated in FIG. 1, an image forming apparatus 900 includes a main body of an image forming apparatus (hereinafter referred to as an image forming apparatus main body) 900A. An image forming portion 902 which forms an image on a sheet and an elevated operation portion 50 are provided on the image forming apparatus main body 900A. An original feeding device 950 which feeds an original to a platen glass (not shown) is provided on an upper surface of the image forming apparatus main body 900A. The image forming portion 902 includes a cylindrical photosensitive drum 906, a charging device 907, and a developing device (developing portion) 909. A fixing device 912 and a pair of discharging rollers 914 are disposed on a downstream side of the image forming portion 902.

An image forming operation of the image forming apparatus 900 having the above-mentioned configuration will be described. When an image forming signal is output from a CPU circuit portion (not shown), first, an original is placed on the platen glass by the original feeding device 950. Then, an image of the original is read by an image reader (not shown), and digital data of the read image is input to an exposing unit (not shown). The exposing unit then irradiates the photosensitive drum 906 with light modulated in accordance with the digital data. At this time, because a surface of the photosensitive drum 906 is uniformly charged by the charging device 907, when the surface of the photosensitive drum 906 is thus irradiated with the light, an electrostatic latent image is formed on the surface of the photosensitive drum 906. When the electrostatic latent image is developed by the developing device 909, a toner image is formed on the surface of the photosensitive drum 906.

On the other hand, when a paper feeding signal is output from the CPU circuit portion, first, a sheet S that is set in cassettes 902*a* to 902*d* or a paper feeding deck 902*e* is conveyed to registration rollers 910. The sheet S is then conveyed by the registration rollers 910 to a transfer portion including a transfer charging device 905 at a timing to match a leading edge of the sheet S and a leading edge of the toner image on the photosensitive drum 906. A transfer bias is applied to the sheet S by the transfer charging device 905 in the transfer portion so that the toner image on the photosensitive drum 906 is transferred to the sheet S. The sheet S to which the toner image is transferred is then conveyed to the fixing device 912 by a conveying belt 911, and the toner image is thermally fixed to the sheet S while passing through the fixing device 912. The sheet S to which the toner image is thermally fixed by the fixing device 912 is then discharged to a discharge tray 915 by the pair of discharging rollers 914.

In FIG. 1, a toner bottle 1 that is a developer replenishment container is removably mounted to the image forming apparatus main body 900A in a horizontal direction. The developer discharged from the toner bottle 1 is temporarily accommodated in a hopper 24 that is a temporary developer accommodating container as an accommodating unit, and then sent to the developing device 909. The toner bottle 1 is disposed above the image forming portion 902 so that the toner bottle 1 is not overlapped with the image forming portion 902.

When replenishing the developer, the toner bottle is configured to be removably put (accommodated) in a developer replenishment container accommodating apparatus (hereinafter referred to as an "accommodating apparatus") illustrated in FIG. 2 that is mounted to the image forming apparatus main body 900A. The accommodating apparatus 20 includes a main body of the developer replenishment container accommodating apparatus (hereinafter referred to as an "apparatus main body") 23 in which the toner bottle 1 is put, and a driving portion 22 configured to rotationally drive the toner bottle 1 put in the apparatus main body 23. The accommodating apparatus 20 further includes the hopper 24 that is a temporary developer accommodating container for temporarily accommodating the developer discharged from the toner bottle 1, and is located between the apparatus main body 23 and the driving portion 22.

The driving portion 22 includes an open/close control member 21 that is movable along a push-in direction in which the toner bottle 1 is pushed in the apparatus main body 23 and is rotatable so as to rotate the toner bottle 1, a driving motor portion 22*a* configured to rotate the open/close control member 21 by a driving motor (not shown), and a power transmission portion 22*b*. When the open/close control member 21 moves to a downstream side in the push-in direction, the driving motor portion 22*a* and the power transmission portion 22*b* are coupled to each other, and after that, when the driving motor portion 22*a* starts the driving, the open/close control member 21 is rotated via the power transmission portion 22*b*.

The hopper 24 includes a hopper main body 24*a*, an agitating member 25 that is disposed in a lower portion of the hopper main body 24*a* and agitates the replenished developer, and a screw member 26 configured to convey the developer to a developer container 11 of the developing device 909 illustrated in FIG. 1.

The apparatus main body 23 includes a support portion 23*a* configured to support the toner bottle 1. A lever 27 which is an engaging piece configured to engage with the toner bottle 1 when the toner bottle 1 is put in the apparatus main body 23 is provided under the support portion 23*a* so as to be slidable along the push-in direction. An engaging portion 27*a* protruding from the support portion 23*a* is provided on an end portion of the lever 27 on the downstream side in the push-in direction. A tip of the engaging portion 27*a* is formed in a rounded shape. A hook 27*b* is provided on an end portion of the lever 27 on an upstream side in the push-in direction. One end of a tension spring 28 is hooked on a hook 23*b* provided on a bottom surface of the support portion 23*a*, and the other end thereof is hooked on the hook 27*b*. The lever 27 is normally biased to the upstream side in the push-in direction by the tension spring 28 that is a biasing member.

Figure 3:
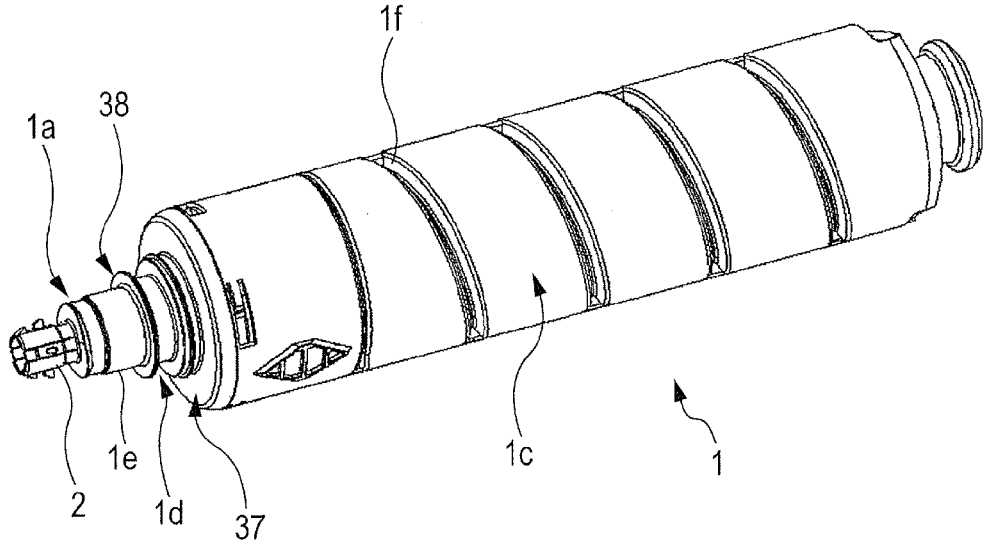
FIG. 3 is a perspective view of a toner bottle to be put in the developer replenishment container accommodating apparatus.

As illustrated in FIG. 3, the toner bottle 1 includes a container main body 1*c* configured to contain the developer, and a cylindrical discharging portion 1*e* provided on an end portion of the container main body 1*c* on the downstream side in the push-in direction. The discharging portion 1*e* is configured to discharge the developer contained in the container main body 1*c*. An opening 1*a* configured to discharge the developer is formed in a distal end of the discharging portion 1*e*. When the toner bottle 1 is unused, the opening 1*a* of the discharging portion 1*e* is sealed by a sealing member 2 which is inserted into the discharging portion 1*e* so as to be pullout from the discharging portion. A spiral groove 1*f* is formed in the container main body 1*c* of the toner bottle 1. With the groove 1*f*, when the container main body 1*c* is rotated about the discharging portion 1*e* which constitutes an axis portion, the developer contained in the container main body 1*c* can be sent to the opening 1*a*. The discharging portion 1*e* which constitutes the axis portion is centered on a rotation axis A as described below and illustrated in FIG. 4.

The discharging portion 1*e* has a diameter smaller than a diameter of the container main body 1*c*. An end surface of the container main body 1*c* which has a diameter larger than the diameter of the discharging portion 1*e* forms a biasing force receiving portion 37. As described later, when the toner bottle 1 is put in the accommodating apparatus 20, the engaging portion 27*a* of the lever 27 is engaged with the biasing force receiving portion 37 which is a portion to be pressed. In addition, a locking groove 1*d* into which a click portion 35*c* of a locking member 35 described later is locked when the toner bottle 1 is put in the accommodating apparatus 20 is formed between the biasing force receiving portion 37 and the opening 1*a*. A flange portion 38 which is disengageably engaged with the click portion 35*c* is provided between the biasing force receiving portion 37 and the opening 1*a*.

Figure 2:
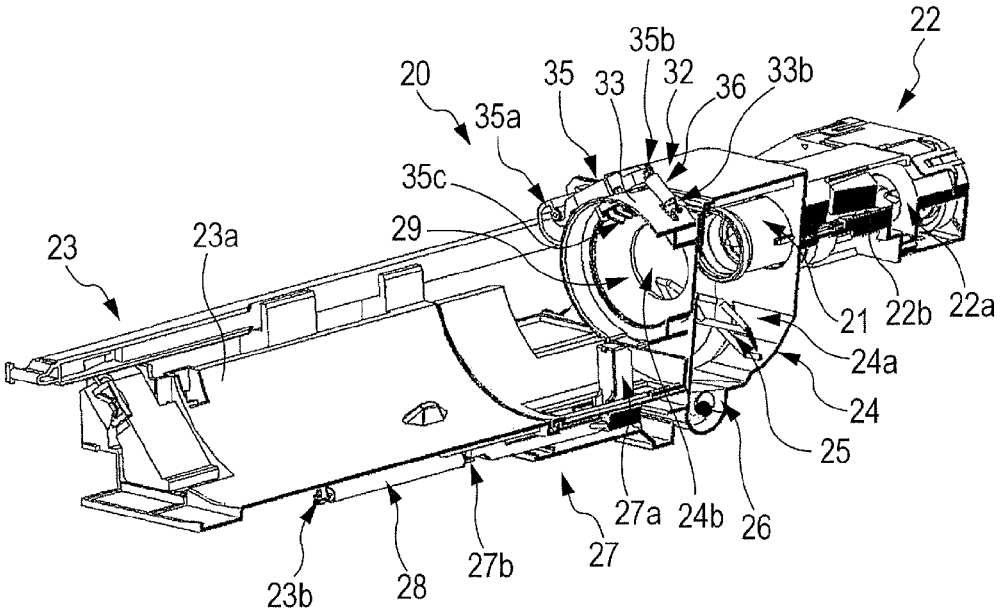
FIG. 2 is a perspective view of the developer replenishment container accommodating apparatus mounted in a main body of the image forming apparatus.

In FIG. 2, a circular opening 24*b* is formed in the hopper main body 24*a*. The circular opening 24*b* has an inner diameter larger than the outer diameter of the discharging portion 1*e* of the toner bottle 1 illustrated in FIG. 3. When the toner bottle 1 is put in the accommodating apparatus 20, the discharging portion 1*e* is inserted into the hopper 24 through the opening 24*b*. When the discharging portion 1*e* is inserted in this manner, the sealing member 2 which seals the opening 1*a* is engaged with the open/close control member 21 while being fitted into the open/close control member 21 which is located on the opposite side of the opening 24*b* of the hopper main body 24*a*.

Figure 29A:
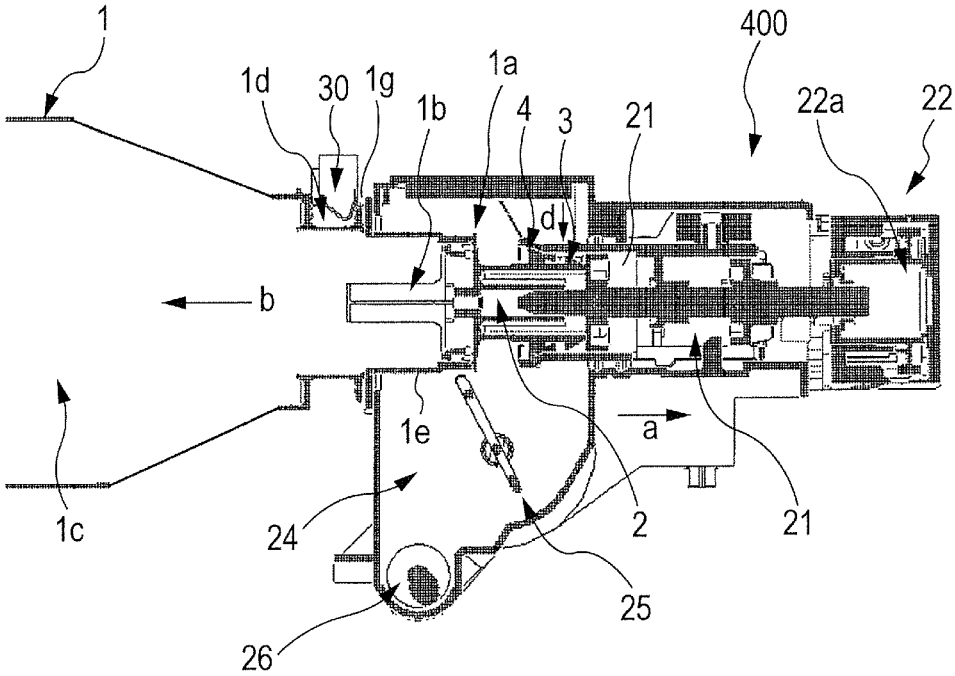
FIGS. 29A and 29B are second diagrams illustrating the state of the developer replenishment container accommodating apparatus and the developer replenishment container when the developer replenishment container is put in the developer replenishment container accommodating apparatus.
Figure 29B:
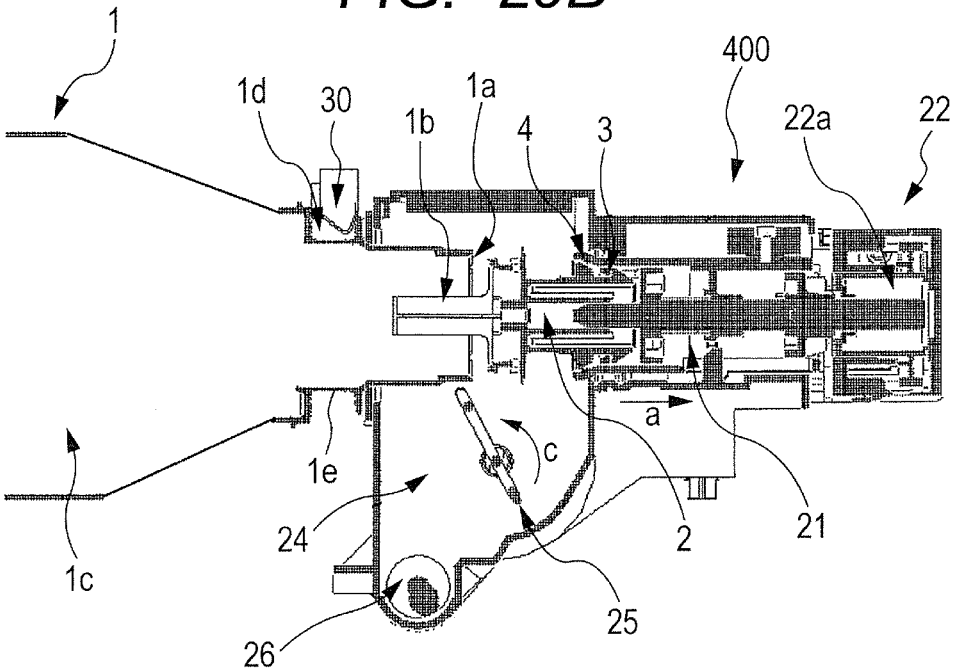
Figure 30A:
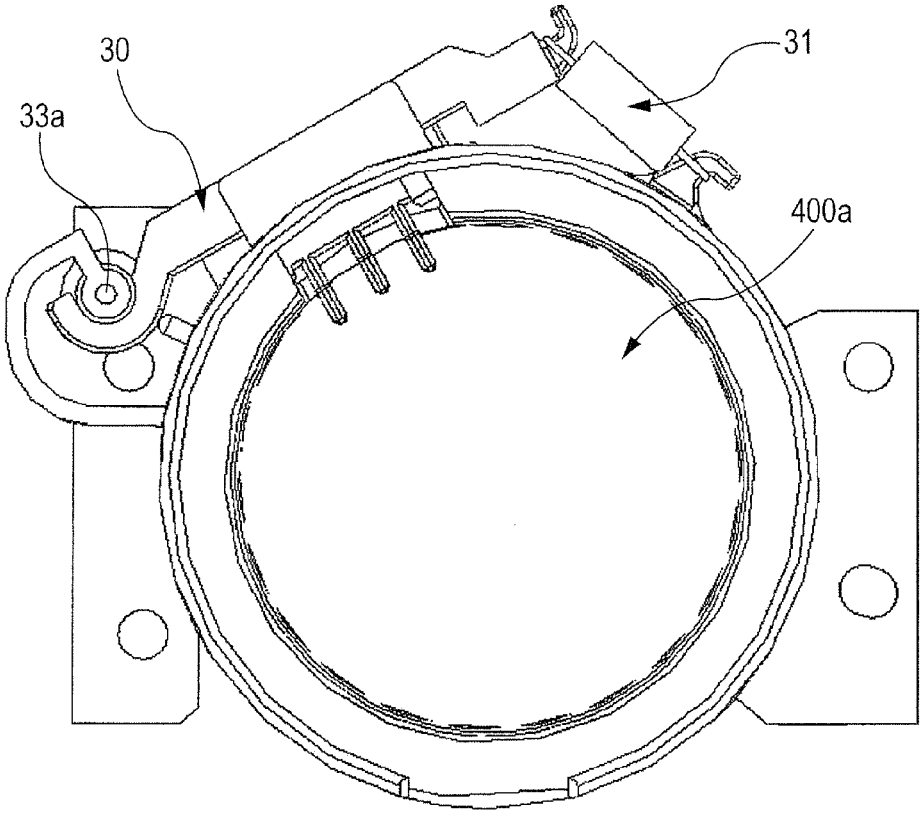
FIGS. 30A and 30B are diagrams illustrating a positioning member provided in the developer replenishment container accommodating apparatus.
Figure 30B:
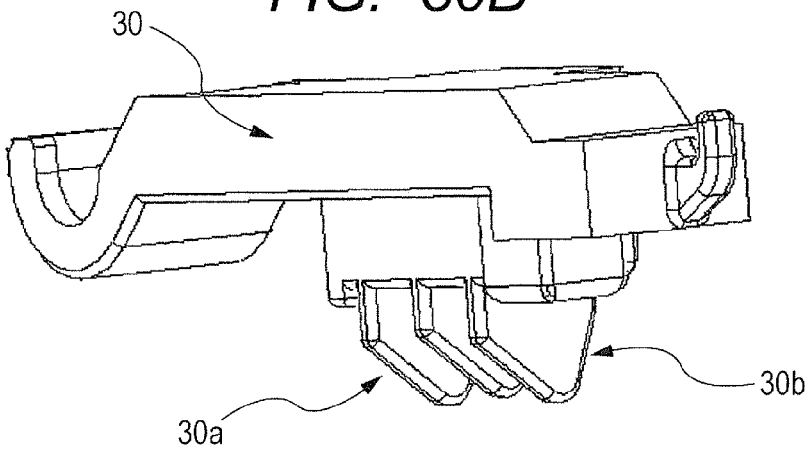

Further after that, when a replacement cover (not shown) is closed, the open/close control member 21 moves to the downstream side in the push-in direction while keeping a state of being engaged with the sealing member 2. With this operation, as illustrated in FIG. 29B described above, the sealing member 2 is separated from the discharging portion 1*e* so that the opening 1*a* is opened, and hence the developer replenishment can be performed. When the driving motor portion 22*a* is driven in this state, the open/close control member 21 is rotated. With the rotation of the open/close control member 21, the sealing member 2 engaged with the open/close control member 21 is rotated.

The rotation of the sealing member 2 is transmitted to a rotation driving portion 1*b* which is provided in the container main body 1*c* and illustrated in FIG. 4 and FIGS. 9A, 9B and 9C described later. When a rib 1*h* provided on an inner side of the container main body 1*c* abuts on the rotation driving portion 1*b*, the container main body 1*c* is rotated about the rotation axis A. At this time, because the rib 1*h* is loosely fitted on the rotation axis A with respect to the rotation driving portion 1*b* (a position is not restricted on the rotation axis A with respect to the rotation driving portion 1*b*), the rib 1*h* and the rotation driving portion 1*b* do not contribute to suppression of looseness of the container main body 1*c* on the rotation axis A. The rotation axis A is a virtual axis extending in the push-in direction of the container main body 1*c*.

Figure 28A:
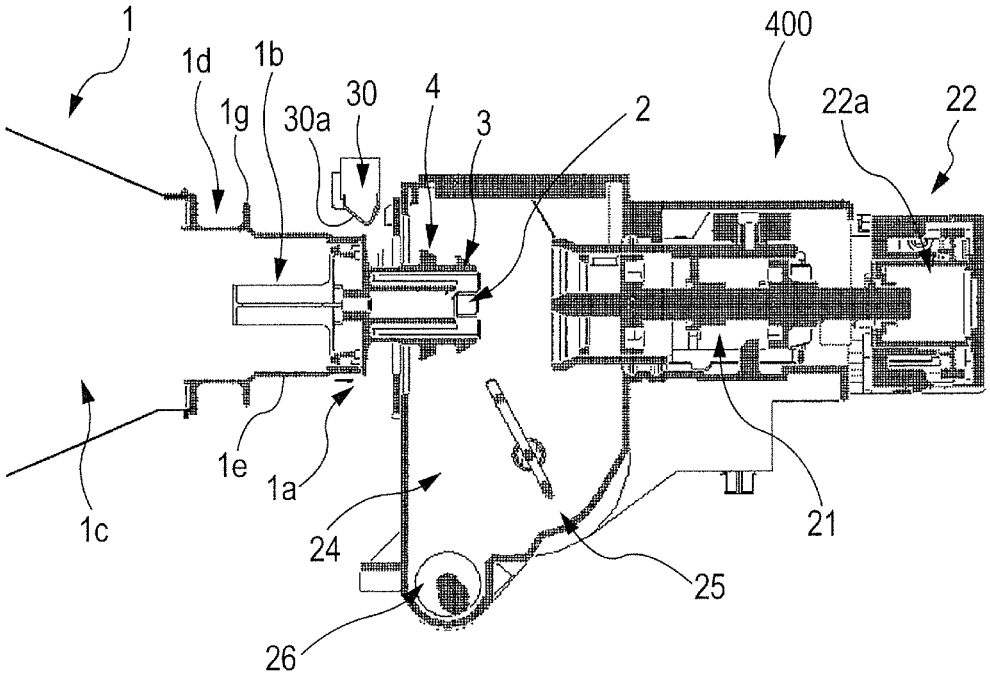
FIGS. 28A and 28B are first diagrams illustrating a state of the developer replenishment container accommodating apparatus and a developer replenishment container when the developer replenishment container is put in the developer replenishment container accommodating apparatus.
Figure 28B:
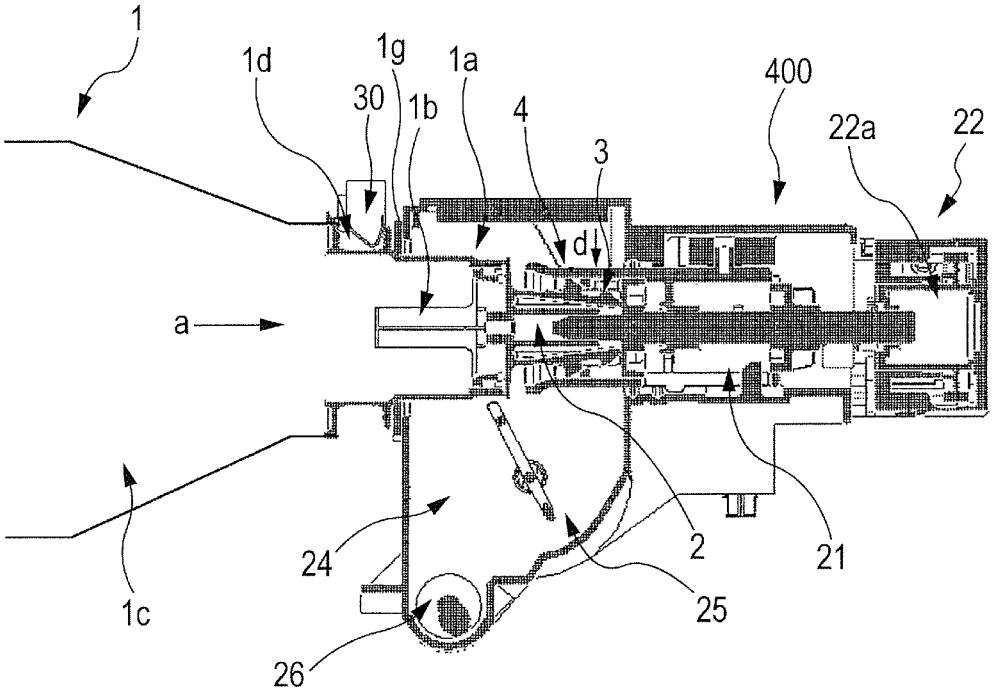

When the replenishment of the developer is completed, the replacement cover is opened. When the replacement cover is opened in this manner, the open/close control member 21 moves from the position illustrated in FIG. 29B described above in the direction indicated by the arrow "b" illustrated in FIG. 29A. With this operation, the engagement of the open/close control member 21 and the sealing member 2 is released as illustrated in FIG. 28B, and the toner bottle 1 can be pulled out of the accommodating apparatus 20.

Further, an elastic member 29 is provided on the upstream side of the hopper main body 24*a* in the push-in direction. The elastic member 29 comes into close contact with the downstream side portion of the toner bottle 1 in the push-in direction so as to prevent a scattering of the developer. The elastic member 29 is formed of a material such as PORON (trademark) into a cylindrical shape (disk shape). A magnetic sensor (not shown) is disposed on the outer side of the hopper 24. The magnetic sensor responds when the developer supplied from the toner bottle 1 to the hopper main body 24*a* reaches a predetermined amount. Accordingly, the supply of the developer from the toner bottle 1 is stopped.

Figure 4:
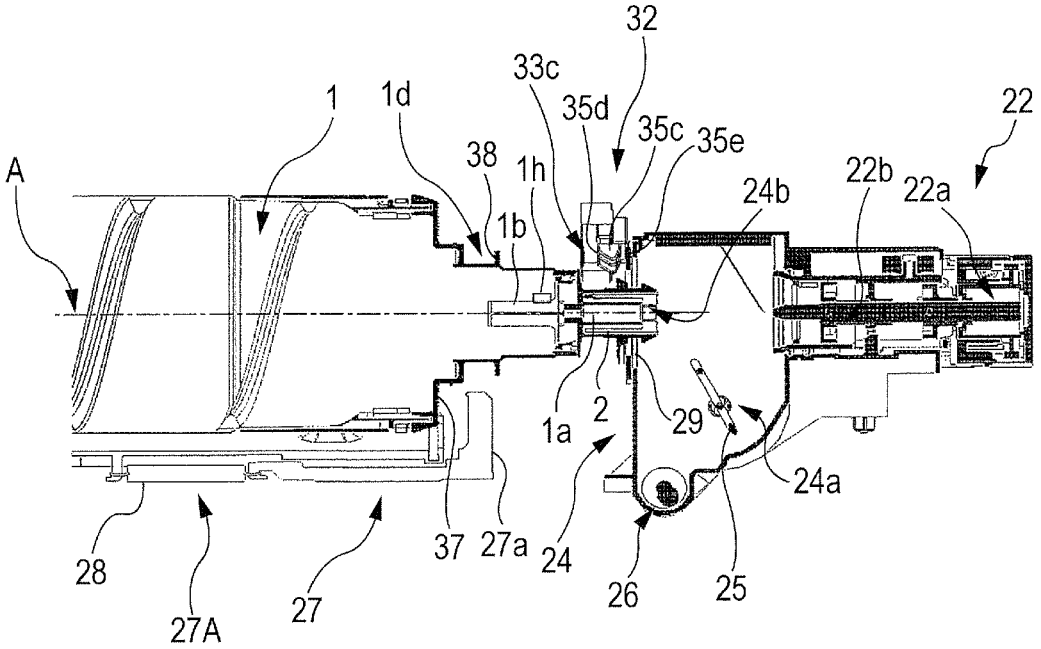
FIG. 4 is a diagram illustrating a state in which the toner bottle is put in the developer replenishment container accommodating apparatus.
Figure 5A:
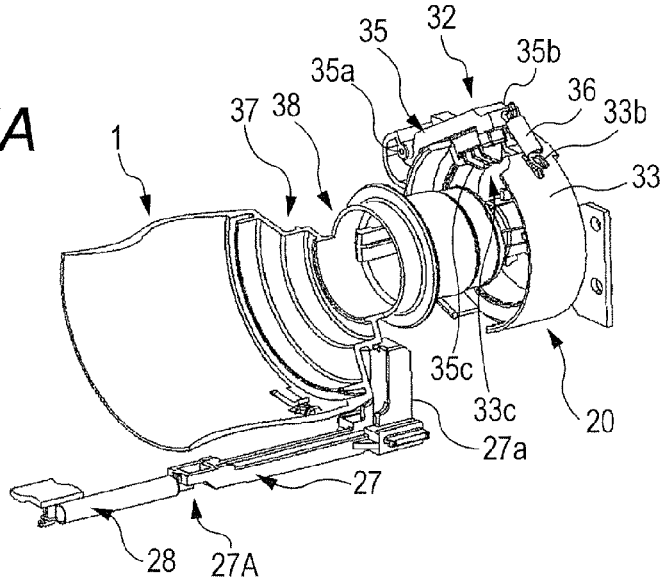
FIGS. 5A, 5B, and 5C are diagrams illustrating operations of a pressing portion and a locking mechanism when the toner bottle is put in the developer replenishment container accommodating apparatus.
Figure 5B:
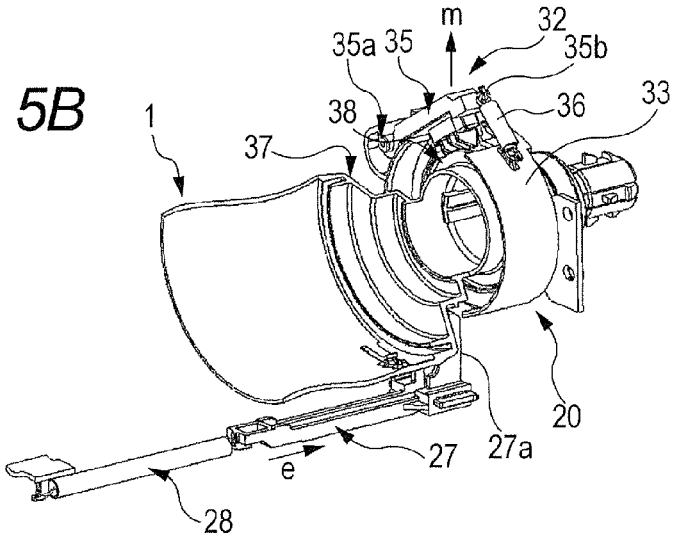
Figure 5C:
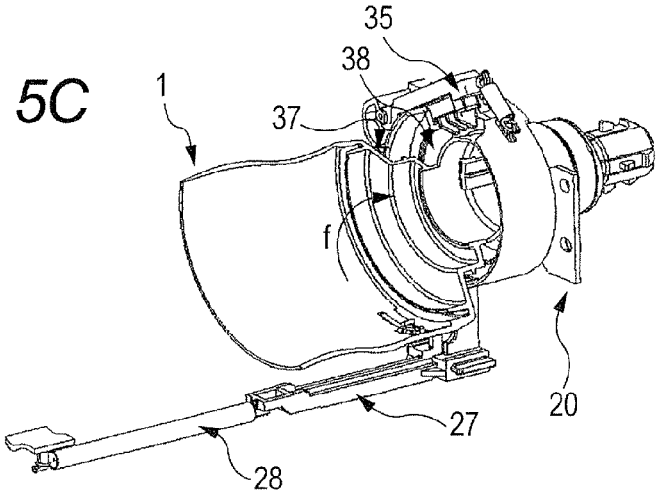

On the other hand, as illustrated in FIG. 4, a lock mechanism 32 which is a holding portion configured to hold the accommodated toner bottle 1 in a replenishment position for supplying the developer is provided on the upstream side of the elastic member 29 in the push-in direction. The lock mechanism 32 includes, as illustrated in FIGS. 5A, 5B, and 5C, a cylindrical support member 33 and the locking member 35 which is a pivot member provided so as to be pivotable about a pivot shaft 35*a* as a pivot point located above a straight line which passes through the center of the support member 33. A hook 35*b* is provided on a rotating end of the locking member 35. One end of a tension spring 36 is hooked on a hook 33*b* provided on the support member 33. The other end of the tension spring 36 is hooked on the hook 35*b*. The locking member 35 is biased toward the support member 33 by the tension spring 36 which is a biasing member.

Further, on a bottom surface of the locking member 35, the click portion 35*c* retractably protruding toward the inner side of the support member 33 through an opening 33*c* formed in the support member 33 is provided. As illustrated in FIG. 4, the click portion 35*c* includes a first tapered portion 35*d* which is declined downward along the push-in direction and a second tapered portion 35*e* which is inclined upward along the push-in direction and located on the downstream side of the first tapered portion 35*d* in the push-in direction.

As illustrated in FIG. 4, the lock mechanism 32 is disposed so that the lock mechanism 32 is located relatively above the lever 27 and the lever 27 is located on the upstream side in the push-in direction. In other words, a pressing portion 27A including the lever 27 and the tension spring 28 and configured to press the toner bottle 1 toward the upstream side in the push-in direction is provided on the apparatus main body 23 in a region located on the upstream side of the lock mechanism 32 in the push-in direction and on a side opposite to the lock mechanism 32.

Operations of the pressing portion 27A and the lock mechanism 32 when the toner bottle 1 is put in the accommodating apparatus 20 configured in the above-mentioned manner will be described. FIG. 5A illustrates a state in which the toner bottle 1 is being inserted into the hopper 24 of the accommodating apparatus 20. At this time, the lever 27 is not in contact with the toner bottle 1, and stands by on the most upstream side of a movable range by the tension spring 28. Similarly, the locking member 35 is held in a position in which the click portion 35*c* is located in a position closest to the rotation center axis of the toner bottle 1 in a movable range of the locking member 35.

After that, when the toner bottle 1 is inserted deep into the hopper 24 so that the biasing force receiving portion 37 of the toner bottle 1 reaches the standby position of the lever 27, the engaging portion 27*a* of the lever 27 is brought into contact with the biasing force receiving portion 37. With this operation, when the toner bottle 1 is kept on being inserted, as illustrated in FIG. 5B, the lever 27 starts to move in a direction indicated by the arrow "e" against a tensile force of the tension spring 28.

When the toner bottle 1 is further inserted, the flange portion 38 of the toner bottle 1 is brought into contact with the first tapered portion 35*d* of the click portion 35*c* of the locking member 35. When the toner bottle is inserted in this state, the first tapered portion 35*d* receives a force from the flange portion 38, and the click portion 35*c* is caused to move in a direction (upward direction) orthogonal to the push-in direction of the toner bottle 1. When this force is stronger than the tensile force of the tension spring 36, the locking member 35 moves in a direction away from the flange portion 38, that is, a direction indicated by the arrow "m". The flange portion eventually presses the locking member 35 completely upward, and moves deeper (in the direction indicated by the arrow "e").

After that, the flange portion 38 moves along the second tapered portion 35*e* of the click portion 35*c*, and with this operation, the locking member 35 moves in the downward direction by the tension spring 36. That is, when the flange portion 38 passes over the click portion 35*c*, as illustrated in FIG. 5C, the locking member 35 returns to the original position by the tensile force of the tension spring 36, and enters into the locking groove 1*d* of the toner bottle 1, which is the portion to be engaged illustrated in FIG. 3. When the click portion 35*c* enters into the locking groove 1*d* in this manner, the toner bottle is elastically held, by the click portion 35*c*, in the replenishment position for supplying the developer.

At this time, the lever 27 continues to constantly bias the biasing force receiving portion 37 of the toner bottle 1. That is, in this embodiment, when the toner bottle 1 is put in the accommodating apparatus 20, a lower portion of the toner bottle 1 which is below the rotation axis A of the toner bottle 1 on the downstream side in the push-in direction is biased by the lever 27. In addition, an upper portion of the toner bottle 1 which is above the rotation axis A of the toner bottle 1 on the downstream side in the push-in direction is locked by the click portion 35*c* of the locking member 35 located on the downstream side of the lever 27 in the push-in direction.

In a state in which the upper portion is locked in this manner, when the biasing force is applied by the lever 27 to the lower portion on the upstream side of the click portion 35*c* of the locking member 35 in the push-in direction, a moment indicated by an arrow f illustrated in FIG. 5C is exerted on the toner bottle 1. With this moment, a side wall of the locking groove 1*d* of the toner bottle 1 on the opposite side of the flange portion 38 is pressed against the click portion 35*c* of the locking member 35, and thus the toner bottle 1 is secured to the accommodating apparatus 20. As a result, even during the rotation by the operation of the driving portion 22, the toner bottle 1 is rotated in a state in which the discharging portion 1*e* is slightly declined downward always without causing a vibration, thus enabling a continuous supply of the developer in a stable manner.

As described above, in this embodiment, when the toner bottle 1 is put in the apparatus main body 23, the toner bottle 1 is secured while being biased and pressed against the lock mechanism 32 (the click portion 35*c* of the locking member 35) by the engaging portion 27*a*. With this configuration, the looseness between the locking groove 1*d* and the click portion 35*c* of the locking member 35 can be eliminated, and therefore, the toner bottle 1 can be rotated without causing a vibration during the replenishment of the developer. As a result, the vibration at the time of replenishment of developer can be suppressed, and an adverse effect of the vibration on the image formation can be prevented. Accordingly, the image quality can be maintained.

Further, by biasing the toner bottle 1 to the upstream side in the push-in direction, i.e., in a pullout direction by the engaging portion 27*a*, when the toner bottle 1 is to be pulled out, the toner bottle 1 can be pulled out by a small force with the aid of the biasing force of the engaging portion 27*a*. Further, by declining the toner bottle 1 with the discharging portion 1*e* being lowered, the toner bottle 1 can be pulled out in an obliquely upward direction when pulling out the toner bottle 1, which improves the operability.

In a case where the toner bottle 1 is not pushed in up to the position in which the toner bottle 1 is locked by the lock mechanism 32 when the toner bottle 1 is to be put in the accommodating apparatus 20, the toner bottle 1 is pushed back by the biasing force (returning force) of the engaging portion 27*a*. Therefore, when the toner bottle 1 is to be put in the accommodating apparatus 20, the user needs to push in the toner bottle 1 against the biasing force of the engaging portion 27*a* up to the position in which the toner bottle 1 is locked by the lock mechanism 32, and hence the toner bottle 1 can be accommodated surely in the accommodating apparatus 20. In addition, because the toner can be discharged in a stable manner by suppressing the vibration of the toner bottle 1, the accuracy of detecting the remaining amount of the developer by the magnetic sensor (not shown) described above is improved.

In this embodiment, the locking groove 1*d* and the biasing force receiving portion 37 are provided in the vicinity of the opening 1*a* of the toner bottle 1, i.e., on the downstream side in the push-in direction. However, the arrangement of the locking groove 1*d* and the biasing force receiving portion 37 is not limited thereto. The locking groove 1*d* and the biasing force receiving portion 37 may be arranged, for example, on an upstream side or a center portion of the toner bottle 1. Further, the open/close control member 21 is moved when sealing the opening 1*a* by the sealing member 2 in the above description, but the present invention is not limited thereto. For example, the operation of the open/close control member 21 may be stopped after releasing the engagement with the sealing member 2, and the sealing of the opening 1*a* may be performed by moving the toner bottle 1 in the push-in direction.

Figure 6:
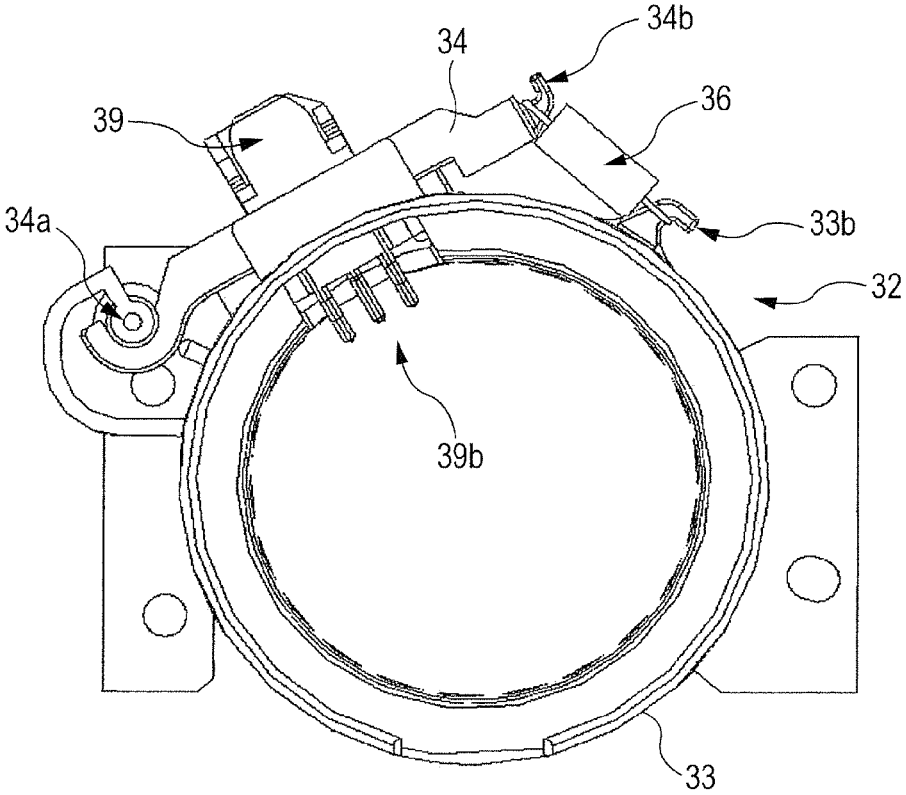
FIG. 6 is a diagram illustrating a configuration of a locking mechanism provided in a developer replenishment container accommodating apparatus according to a second embodiment of the present invention.

A second embodiment of the present invention will be described below. FIG. 6 is a diagram illustrating a configuration of a lock mechanism provided in the accommodating apparatus 20 according to the second embodiment. In FIG. 6, the same reference symbols as those in FIG. 2 described above indicate the same or equivalent portions.

In FIG. 6, a locking member 34 is provided so as to be pivotable about a pivot shaft 34*a* as a pivot point located above a straight line which passes through the center of the support member 33. A hook 34*b* is provided on a rotating end of the locking member 34 which is a pivot member. One end of the tension spring 36 is hooked on the hook 33*b* provided on the support member 33, and the other end thereof is hooked on the hook 34*b*. The locking member 34 is biased toward the support member 33 by the tension spring 36.

Figure 7:
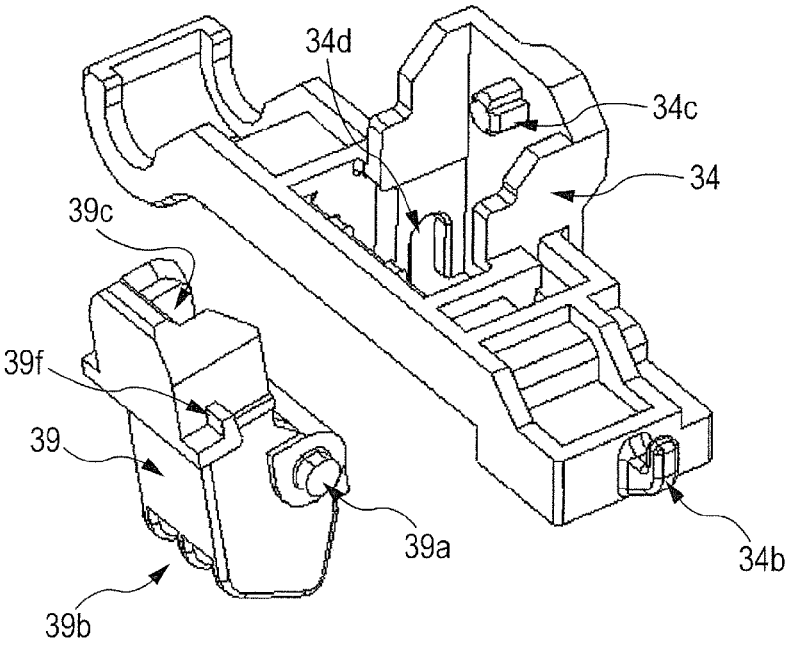
FIG. 7 is a diagram illustrating configurations of a lock member and a click member constituting the locking mechanism illustrated in FIG. 6.

Further, on the locking member 34, a click member retractably protruding toward the inner side of the support member 33 through an opening formed in the support member 33 is pivotably provided. In addition, as illustrated in FIG. 7, the locking member 34 includes a pair of U-shaped support portions 34*d* configured to support the click member 39 so as to be pivotable and movable in the up and down direction. In FIG. 7, one of the U-shaped support portions 34*d* is not illustrated. Shafts 39*a* protruding from both side ends of the click member 39 are assembled in the U-shaped support portions 34*d*. Accordingly, the click member 39 can move in the up and down direction and pivot about the shaft 39*a* as a pivot point.

Figure 8A:
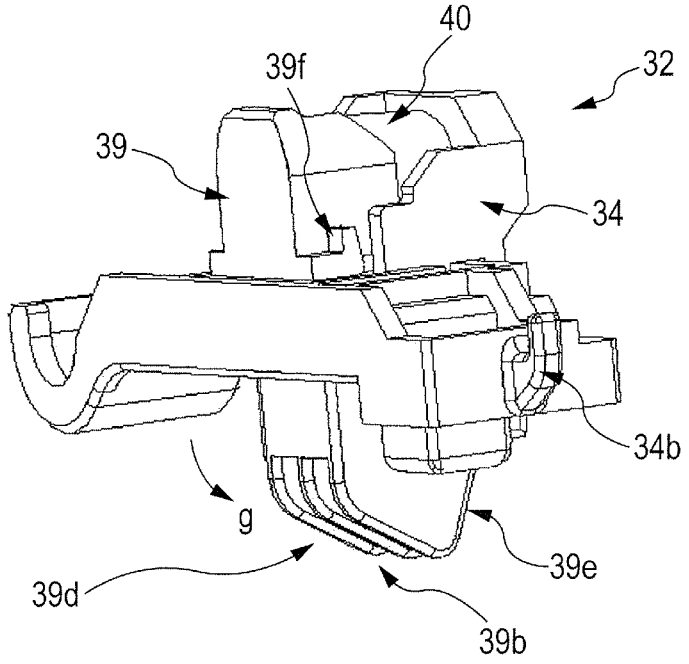
FIGS. 8A and 8B are diagrams illustrating an operation of the click member.
Figure 8B:
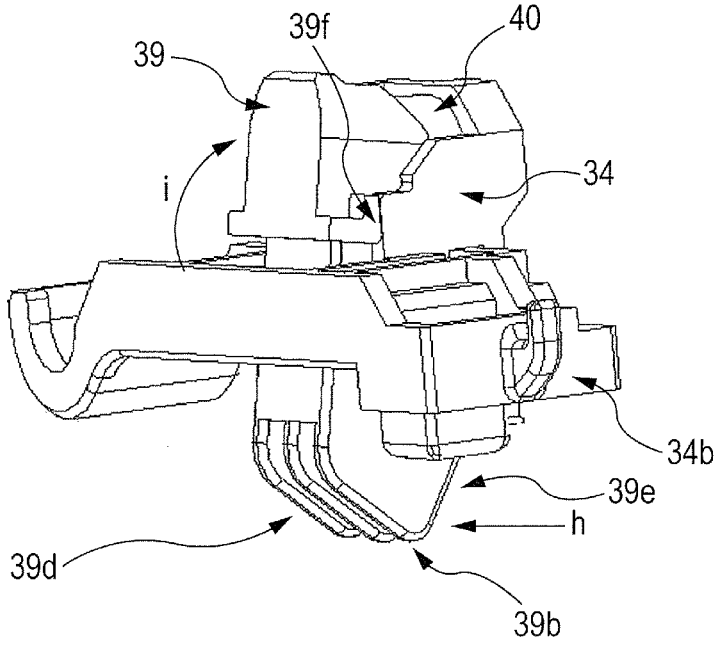

After assembling the click member 39 in the locking member 34 in the above-mentioned manner, a compression spring 40 illustrated in FIGS. 8A and 8B is assembled between a protruded portion 34*c* provided on the locking member 34 and a biasing member receiving portion 39*c* provided on an upper portion of the click member 39. With this configuration, the click member 39 is held in a state of being biased in a direction indicated by the arrow "g" illustrated in FIG. 8A with respect to the locking member 34.

In addition, as illustrated in FIG. 7, a click portion 39*b* is formed on a lower portion of the click member 39. On the click portion 39*b*, as illustrated in FIGS. 8A and 8B, a first tapered portion 39*d* which is declined downward along the push-in direction and a second tapered portion 39*e* which is located on the downstream side of the first tapered portion 39*d* in the push-in direction and inclined upward along the push-in direction are formed. In addition, a pivot restricting portion 39*f* is provided in the vicinity of a part of the shaft 39*a* on the side of the biasing member receiving portion 39*c*.

In a lock mechanism having the above-mentioned configuration, normally, the click member 39 is held in a position illustrated in FIG. 8A by being biased by the compression spring 40 via the biasing member receiving portion 39*c*. On the other hand, for example, as illustrated in FIG. 8B, when a force "h" is applied to the click portion 39*b* of the click member 39, the click member is pivoted in a direction indicated by the arrow "i" about the shaft 39*a* against the biasing force of the compression spring 40.

When the click member 39 is pivoted by the force "h" in the above-mentioned manner, the pivot restricting portion 39*f* eventually abuts on the locking member 34. With this configuration, the click member 39 is pivoted by a predetermined amount and then stopped. In this embodiment, the pivot restricting portion 39*f* abuts on the locking member 34 when the click member 39 is tilted by 10 degrees, but the restriction angle is not limited thereto.

Figure 9A:
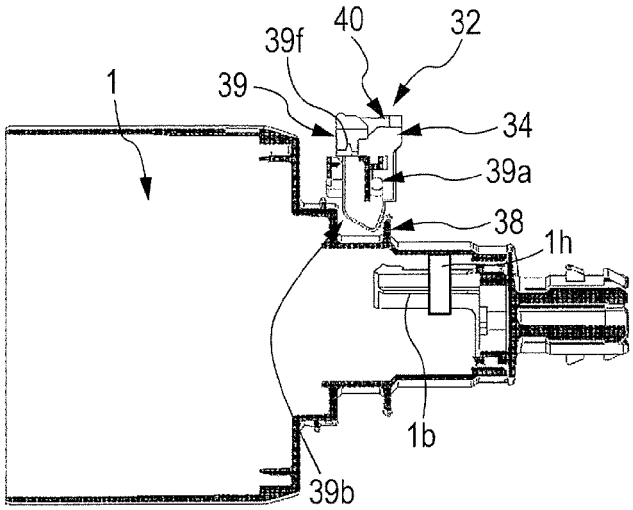
FIGS. 9A, 9B, and 9C are diagrams illustrating an operation of the locking mechanism when removing a toner bottle.

A series of operations of removing the toner bottle 1 when using the lock mechanism 32 having the above-mentioned configuration will be described below. FIG. 9A illustrates a state in which the toner bottle 1 is put (accommodated) in the accommodating apparatus 20. In this state, the toner bottle 1 is locked in a manner that the flange portion 38 is sandwiched by the click portion 39*b* of the click member 39 and the elastic member 29.

Figure 9B:
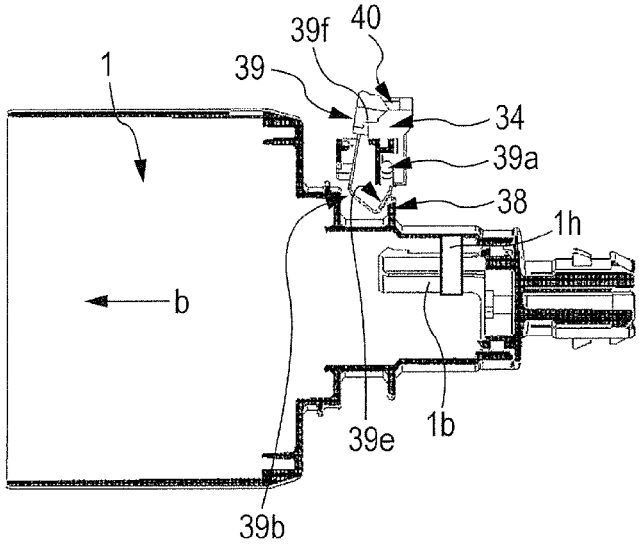

When the toner bottle 1 is moved in the direction indicated by the arrow "b" as illustrated in FIG. 9B in order to remove the toner bottle 1, first, the flange portion 38 is brought into contact with the second tapered portion 39*e* of the click portion 39*b* of the click member 39. In this state, when the user gradually increases the force in the direction indicated by the arrow "b", the flange portion 38 applies the force "h" to the second tapered portion 39*e* as illustrated in FIG. 8B described above. With this operation, the click member 39 is pivoted upward about the shaft 39*a* against the biasing force of the compression spring 40. After that, as illustrated in FIG. 9B, the click member 39 pivoted in this manner is stopped when the pivot restricting portion 39*f* abuts on the locking member 34. When the click member 39 is pivoted in this manner, the toner bottle 1 is slightly moved in the direction indicated by the arrow "b".

Figure 9C:
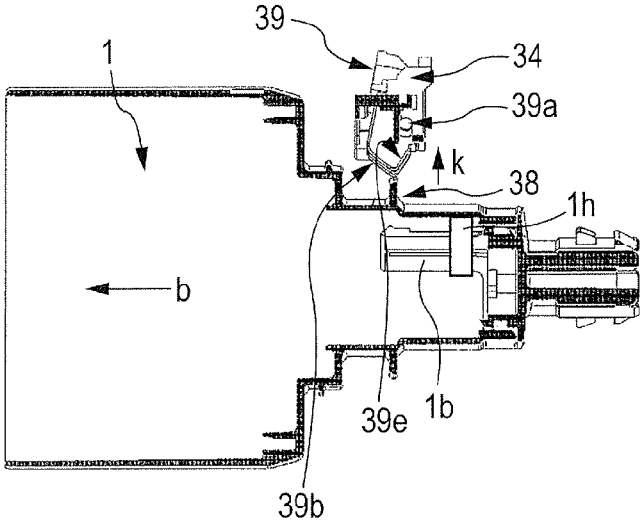

After that, when the user further pulls the toner bottle 1, as illustrated in FIG. 9C, while the click member maintains the state in which the pivot restricting portion 39*f* abuts on the locking member 34, the flange portion 38 presses up the click member 39 in a direction indicated by the arrow "k" via the second tapered portion 39*e*. With this operation, the locking member 34 which has been located in the engaging position in which the click member 39 is engaged with the toner bottle 1 is pivoted about the pivot shaft 34*a* in the upward direction against the tensile force of the tension spring 36, and moved to an engagement release position in which the engagement of the click member 39 with the toner bottle 1 is released. As a result, the lock by the lock mechanism 32 is released, and the toner bottle 1 can be removed from the accommodating apparatus 20.

Figure 10:
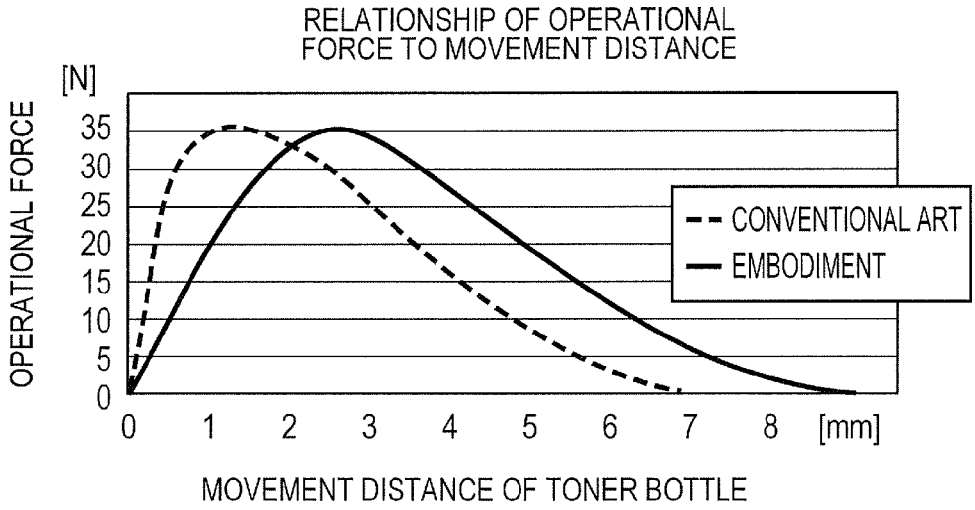
FIG. 10 is a graph showing a relationship between an operational force required for a user to remove the toner bottle and a movement distance of the toner bottle.

FIG. 10 is a graph showing a relationship between an operational force F required for the user to remove the toner bottle 1 and a movement distance L of the toner bottle 1. In FIG. 10, a curve representing the relationship between the operational force F and the movement distance L in the case of removing the toner bottle in the conventional lock mechanism illustrated in FIGS. 27 to 30B described above is indicated by a broken line. A curve representing the relationship between the operational force F and the movement distance L in the case of removing the toner bottle in the lock mechanism 32 according to this embodiment is indicated by a solid line.

In the conventional configuration, after the flange portion 38 abuts on the second tapered portion 30*b*, the positioning member 30 is pivoted about a shaft 33*a*. Therefore, a large operational force is required against the biasing force of the biasing member 31 in a period in which the toner bottle 1 is slightly moved along the second tapered portion 30*b* until the positioning member 30 is pressed completely upward. As a result, as can be seen from the curve indicated by the broken line, the operational force F is applied at an angle close to the virtually right angle, and immediately after the flange portion 38 passes over the second tapered portion 30*b*, the operational force F is attenuated.

On the other hand, in this embodiment, when the flange portion 38 abuts on the second tapered portion 39*e*, first, the click member 39 is pivoted by a predetermined amount. With this operation, an operational force against the biasing force of the compression spring 40 which biases the click member 39 is required while the toner bottle 1 is moved by a distance corresponding to the pivotal movement of the click member 39. After that, while the click member maintains the state in which the pivot restricting portion 39*f* abuts on the locking member 34, the locking member 34 is pivoted about the pivot shaft 34*a* so as to release the flange portion 38. Therefore, as can be seen from the curve indicated by the solid line, a slope of the curve representing the operational force F with respect to the movement distance becomes smaller than that of the conventional configuration, and immediately after the flange portion 38 eventually passes over the second tapered portion 39*e*, the operational force F is attenuated.

Further, in the conventional configuration, an abrupt operational force is required at the moment when the user applies a force to remove the toner bottle 1. In this case, the user feels heavy because the movement amount of the toner bottle 1 is considerably small. In addition, the user may feel that the toner bottle cannot be pulled out or the toner bottle may be broken. However, in this embodiment, the distance L from the start of the movement to a point at which the operational force F reaches the peak is longer than that of the conventional configuration. That is, the movement amount of the toner bottle 1 with respect to the operational force F required at the moment when the user applies a force to remove the toner bottle 1 is larger compared to that of the conventional configuration. Therefore, even when the magnitude of the operational force F is the same as that of the conventional configuration, the toner bottle 1 can be removed without causing an uncomfortable feeling about the removing operation.

Figure 11:
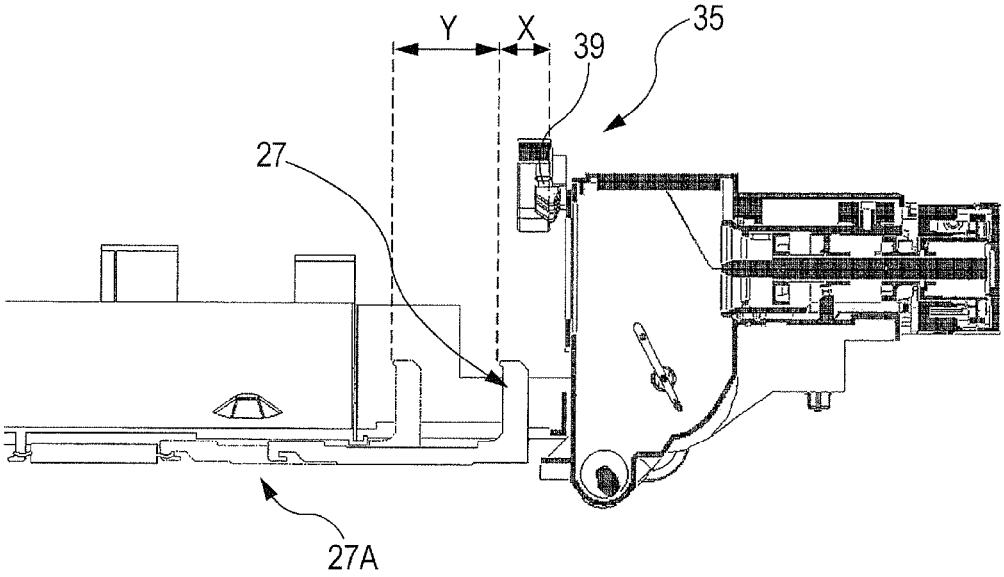
FIG. 11 is a diagram illustrating a positional relationship between the locking mechanism and a lever.

FIG. 11 is a diagram illustrating a distance X between the lever 27 and the click member 39 and a movable range Y of the lever 27 according to this embodiment. In this embodiment, the movable range (movement distance) Y is set longer than the distance X. With this configuration, when the toner bottle 1 cannot be securely accommodated in the accommodating apparatus 20, the toner bottle 1 is returned by the lever 27 by an amount of the movable range Y, thus enabling the user to recognize that the toner bottle 1 is not accommodated.

As described above, in this embodiment, an operation feeling of the user when removing the toner bottle 1 is improved through the pivoting of the click member 39 before the flange portion 38 of the toner bottle presses up the click member 39, as well as the same effect as in the first embodiment described above being brought out. As a result, when removing the toner bottle 1, the fear or the discomfort of the user can be eliminated.

After the toner bottle 1 is put in the accommodating apparatus 20 as described above, the replacement cover is closed so that the open/close control member 21 in the state of being engaged with the sealing member 2 is moved to a position in which the sealing member 2 is opened. Thus, the sealing by the sealing member 2 is released and the opening 1*a* is unsealed. In addition, when replacing the toner bottle 1, the replacement cover is opened so that the open/close control member 21 is moved in the opposite direction. Thus, the opening 1*a* is sealed by the sealing member 2.

However, when opening the replacement cover, if the opening of the replacement cover is not sufficient, the opening 1*a* is not fully sealed by the sealing member 2, and therefore, if the toner bottle 1 is pulled out in this state, the developer may be scattered. For this reason, in the accommodating apparatus 20 according to the above-mentioned first and second embodiments, an open/close control member moving mechanism configured to cause the sealing member 2 to seal the opening 1*a* surely when pulling out the toner bottle 1 is provided. The open/close control member moving mechanism will be described below.

Figure 12:
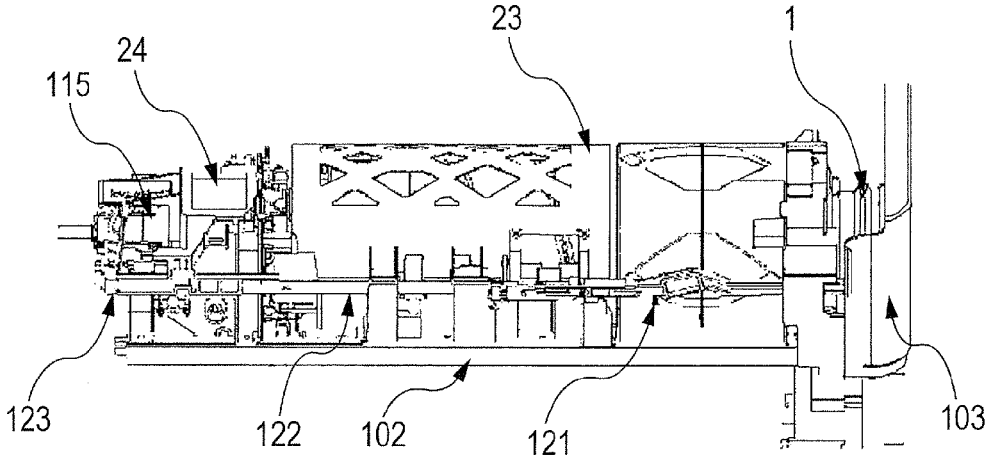
FIG. 12 is a diagram illustrating an open/close control member moving mechanism provided in the developer replenishment container accommodating apparatus according to the first and second embodiments.

FIG. 12 is a diagram illustrating the open/close control member moving mechanism. In FIG. 12, an open/close control member moving mechanism 102 includes a replacement cover 103 which is opened and closed when replacing the toner bottle 1, a sealing member opening/closing mechanism 115, and a link member 121 and a coupling member 122 configured to couple the replacement cover 103 and the sealing member opening/closing mechanism 115.

The link member 121 is coupled to the replacement cover 103. The coupling member 122 which is coupled to the link member 121 is coupled to the sealing member opening/closing mechanism 115 at a rotary shaft 123. When the opening and closing of the replacement cover 103 is operated, the sealing member opening/closing mechanism 115 is actuated by the link member 121 and the coupling member 122 in conjunction with the opening and closing operation, and thus the open/close control member 21 is moved.

Figure 13A:
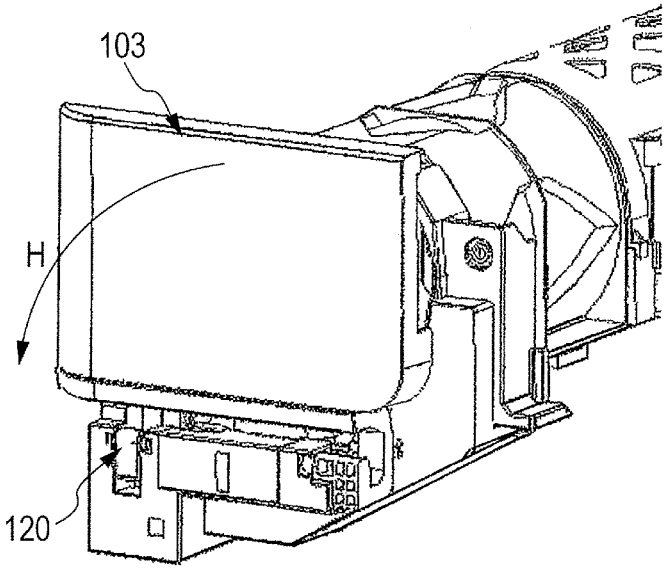
FIGS. 13A and 13B are first diagrams illustrating a configuration of the open/close control member moving mechanism.
Figure 13B:
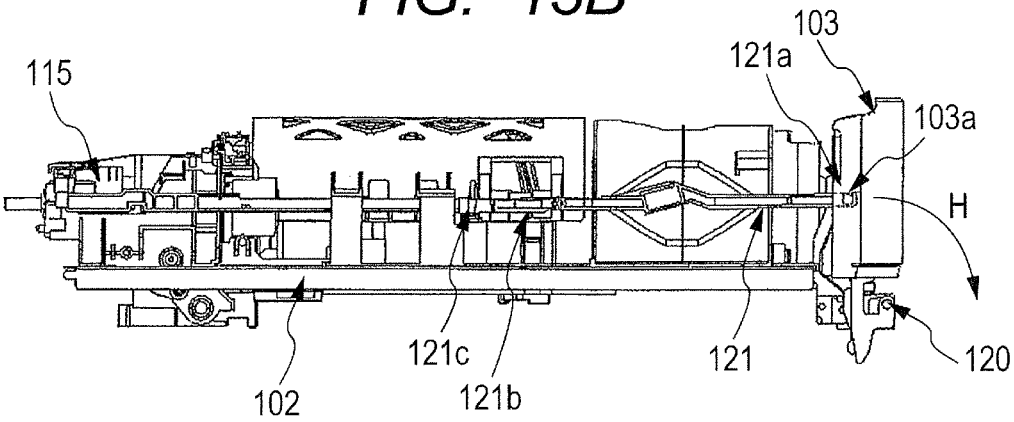

As illustrated in FIGS. 13A and 13B, the replacement cover 103 is pivotable about a pivot shaft 120 as a pivot point in the up and down direction. A protruded portion 103*a* is provided on the replacement cover 103. On the other hand, a pivot hole 121*a* is provided in the link member 121. By inserting the protruded portion 103*a* into the pivot hole 121*a*, the replacement cover 103 is pivotable as described later so that the link member 121 is moved via the protruded portion 103*a*.

Figure 14:
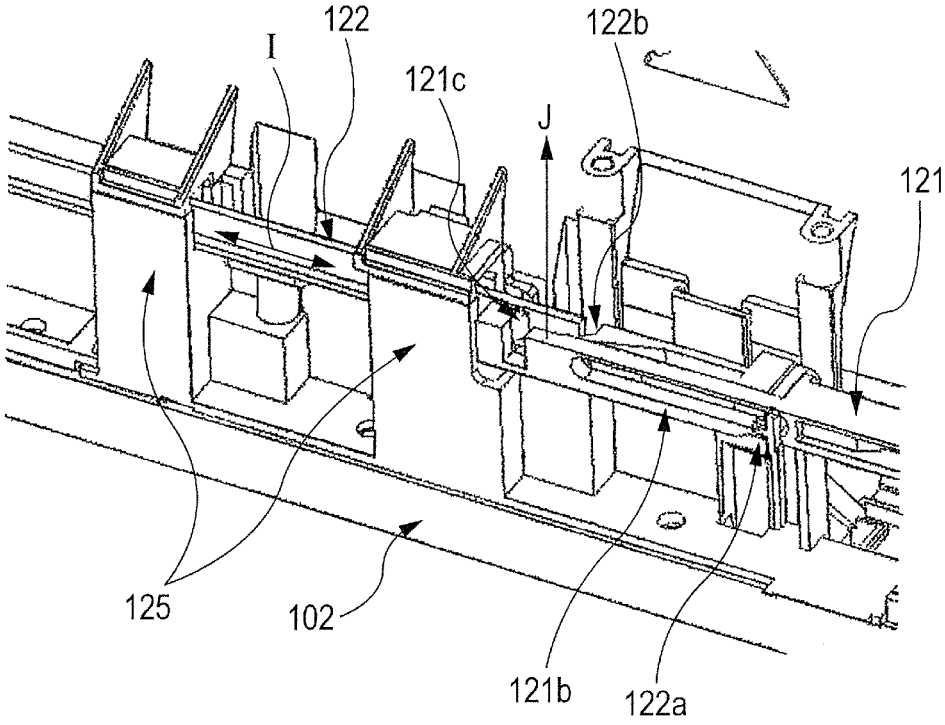
FIG. 14 is a second diagram illustrating the configuration of the open/close control member moving mechanism.

Further, an elongated hole 121*b* is provided on an end portion of the link member 121 on the downstream side in the push-in direction, and an engaging protrusion 121*c* is provided on an end of the link member 121 on the downstream side in the push-in direction. Further, as illustrated in FIG. 14, a protruded portion 122*a* and an engaging protrusion 122*b* are provided on the coupling member 122. The protruded portion 122*a* of the coupling member 122 is inserted into the elongated hole 121*b* of the link member 121. In addition, the engaging protrusion 122*b* is configured to be engaged with the engaging protrusion 121*c* of the link member 121 when the link member 121 is moved. A rail member 125 is provided on the accommodating apparatus 20 so that the coupling member 122 is restricted to move only in a direction indicated by the arrow I.

Figure 15A:
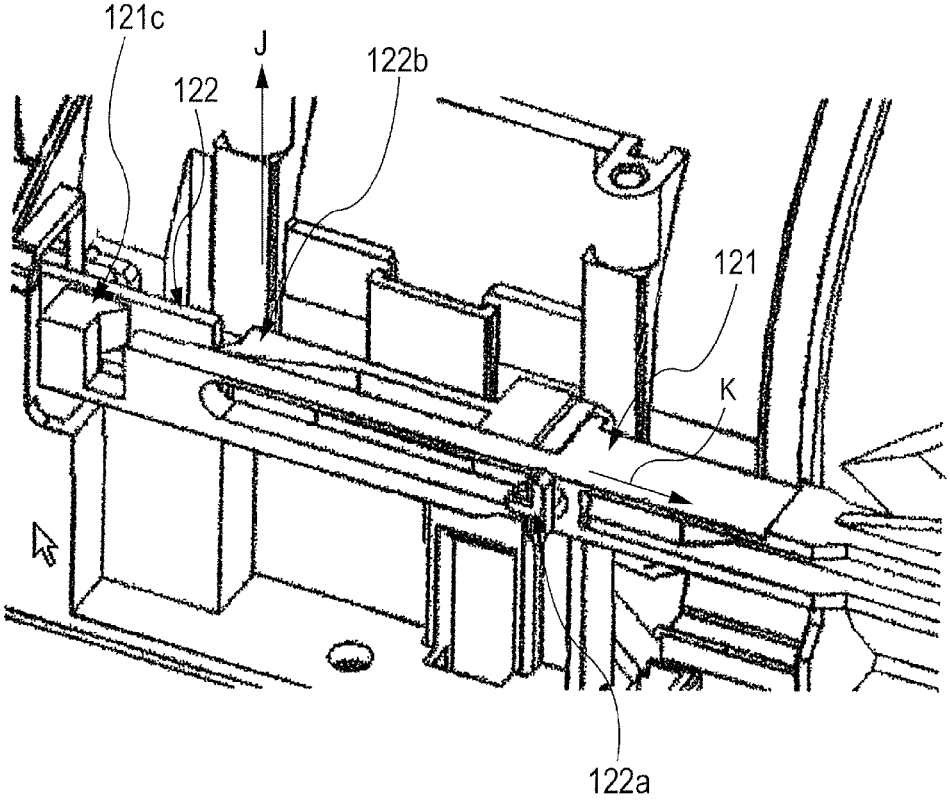
FIGS. 15A and 15B are first diagrams illustrating an operation of the open/close control member moving mechanism when removing a set toner bottle from the developer replenishment container accommodating apparatus.

An operation of the open/close control member moving mechanism 102 having the above-mentioned configuration when removing the set toner bottle 1 from the accommodating apparatus 20 will be described below. In order to remove the toner bottle 1, first, the user pivots the replacement cover 103 about the pivot shaft 120 as a pivot point in a direction indicated by the arrow H as illustrated in FIGS. 13A and 13B. The link member 121 is then moved in a direction indicated by the arrow K as illustrated in FIG. 15A in conjunction with the movement of the protruded portion 103*a* of the replacement cover 103 along with the pivotal movement of the replacement cover 103.

Figure 15B:
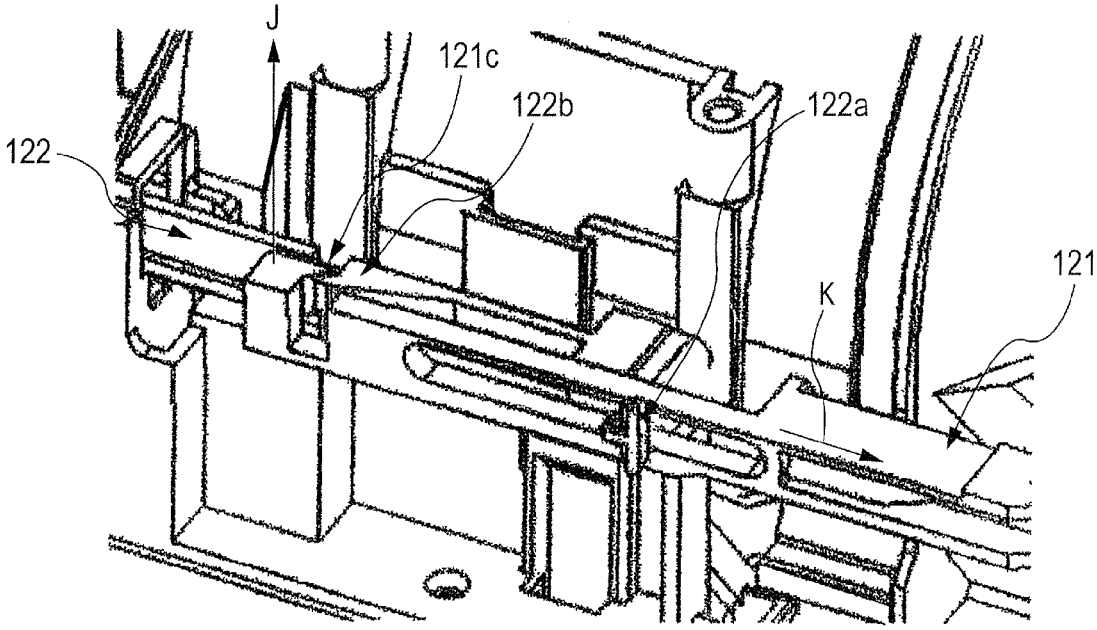

With this operation, the engaging protrusion 121*c* of the link member 121 and the engaging protrusion 122*b* of the coupling member 122 which have been separated from each other are engaged with each other as illustrated in FIG. 15B. As a result, the coupling member 122 is also moved integrally with the link member 121 in the direction indicated by the arrow K. By the movement of the coupling member 122 in the direction indicated by the arrow K, the sealing member opening/closing mechanism 115 which is coupled to the coupling member 122 at the rotary shaft 123 is moved, and the sealing of the toner bottle 1 by the sealing member 2 is performed.

Along with the opening of the replacement cover 103, as illustrated in FIG. 13B, the protruded portion 103*a* of the replacement cover 103 is also pivoted in the direction indicated by the arrow H. Therefore, an initial operating direction of the link member 121 which is moved along with the opening of the replacement cover 103 has a large movement component in the direction indicated by the arrow K illustrated in FIG. 15A. However, a slight movement component in a direction indicated by the arrow J is generated with the protruded portion 122*a* as a fulcrum. When the link member 121 is further moved in the direction indicated by the arrow K, the movement component in the direction indicated by the arrow J at a portion of the link member 121 on the downstream side in the push-in direction is increased.

Figure 16A:
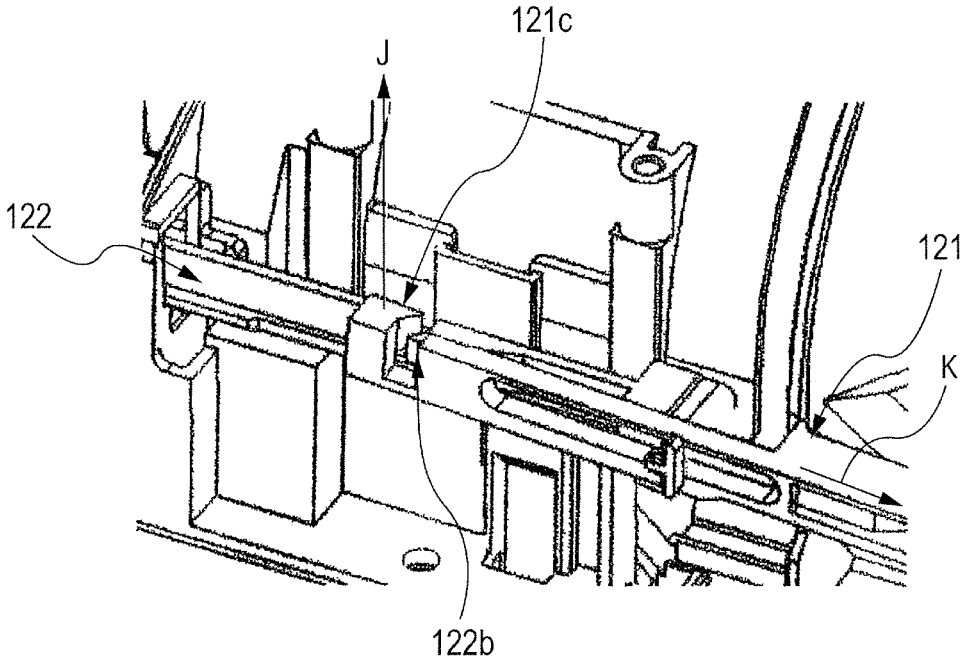
FIGS. 16A and 16B are second diagrams illustrating the operation of the open/close control member moving mechanism when removing the set toner bottle from the developer replenishment container accommodating apparatus.

When the movement component in the direction indicated by the arrow J at the portion of the link member 121 on the downstream side in the push-in direction is increased in the above-mentioned manner, the engaging protrusion 121*c* of the link member 121 is lifted in the direction indicated by the arrow J, and accordingly an engaging amount of the engaging protrusion 122*b* of the coupling member 122 with the engaging protrusion 121*c* of the link member 121 is decreased as illustrated in FIG. 16A. Even though the engaging amount is gradually decreased in this manner, the link member 121 moves the coupling member 122 in the direction indicated by the arrow K up to the position in which the sealing member 2 completely seals the opening 1*a* of the toner bottle 1.

Figure 16B:
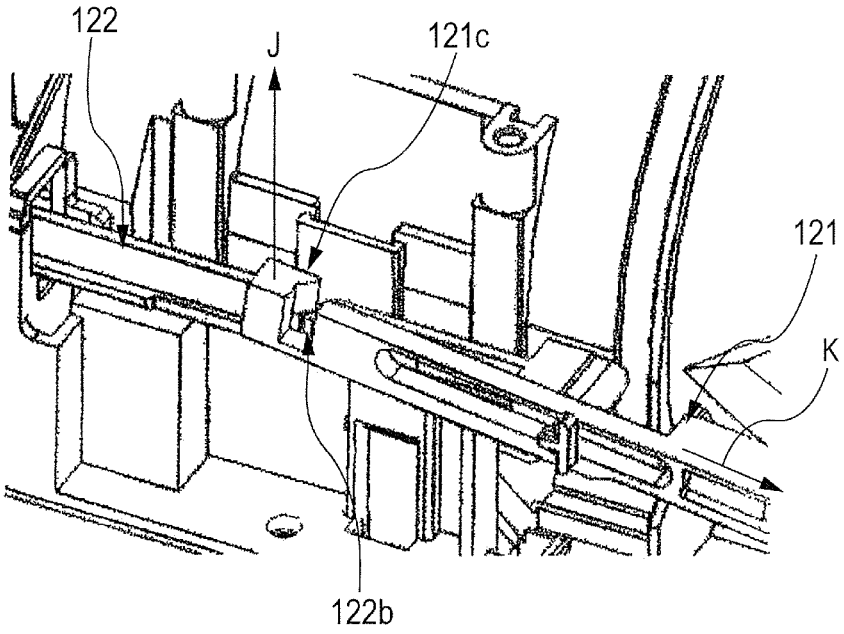
Figure 17A:
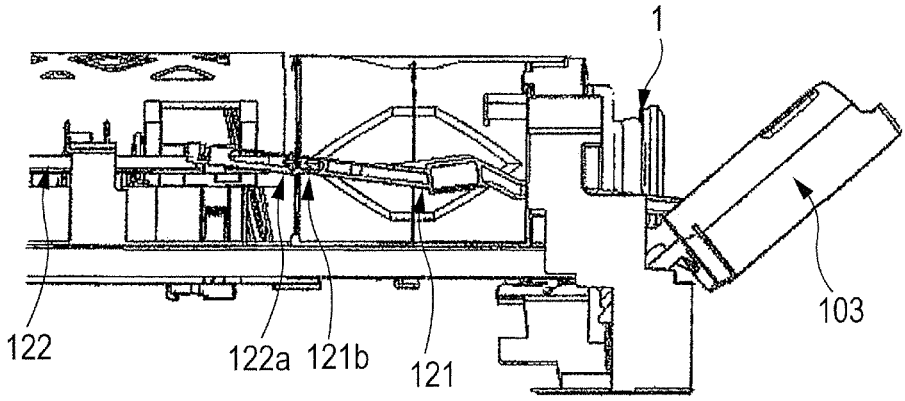
FIGS. 17A and 17B are third diagrams illustrating the operation of the open/close control member moving mechanism when removing the set toner bottle from the developer replenishment container accommodating apparatus.

When the sealing operation is completed, the engaging amount becomes zero, and the engaging protrusion 121*c* is separated from the engaging protrusion 122*b* as illustrated in FIG. 16B. That is, the movement component of the engaging protrusion 121*c* of the link member 121 in the direction indicated by the arrow J becomes larger between the start of sealing of the toner bottle 1 by the sealing member opening/closing mechanism 115 and the end of sealing. When the sealing operation is completed, the engaging protrusion 121*c* is separated from the engaging protrusion 122*b*. Until the sealing operation is completed in this manner, the replacement cover 103 is in the position as illustrated in FIG. 17A before the replacement cover 103 is fully opened. Therefore, the toner bottle 1 cannot be pulled out. With this operation, the scattering of the toner due to the user's pulling out the toner bottle before the toner bottle 1 is sealed can be prevented without fail.

Figure 17B:
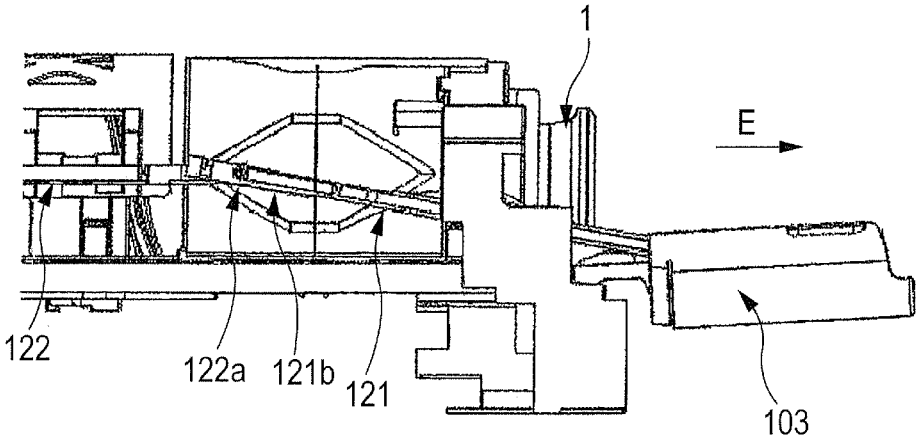

After that, as illustrated in FIG. 16B, the engagement of the engaging protrusion 121*c* and the engaging protrusion 122*b* is released so that only the link member 121 is moved. With this operation, as illustrated in FIG. 17B, the protruded portion 122*a* of the coupling member 122 which is connected in the elongated hole 121*b* of the link member 121 eventually abuts on the left end portion of the elongated hole 121*b*. As a result, the movement of the link member 121 is stopped. At this time, the replacement cover 103 which is associated with the link member 121 is fully opened. In this state, the user can pull out the toner bottle 1 in the direction indicated by the arrow E.

In this manner, until the sealing member 2 reaches the position in which the opening 1*a* of the toner bottle 1 is completely sealed, the replacement cover 103 is not fully opened so that the scattering of the toner due to the user's pulling out the toner bottle 1 before the toner bottle 1 is sealed can be prevented without fail.

Figure 18:
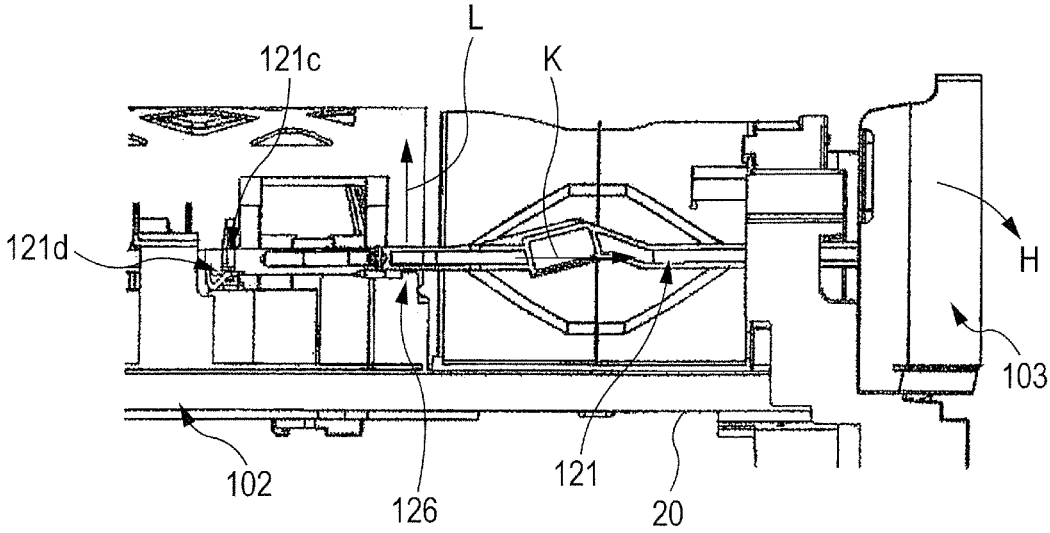
FIG. 18 is a diagram illustrating a first other configuration of the open/close control member moving mechanism.

The configuration of the open/close control member moving mechanism 102 is not limited to the above-mentioned configuration. A first other configuration of the open/close control member moving mechanism 102 will be described below. FIG. 18 is a diagram illustrating the first other configuration of the open/close control member moving mechanism 102. In FIG. 18, the same reference symbols as those in FIGS. 13A and 13B described above indicate the same or equivalent portions.

Figure 19:
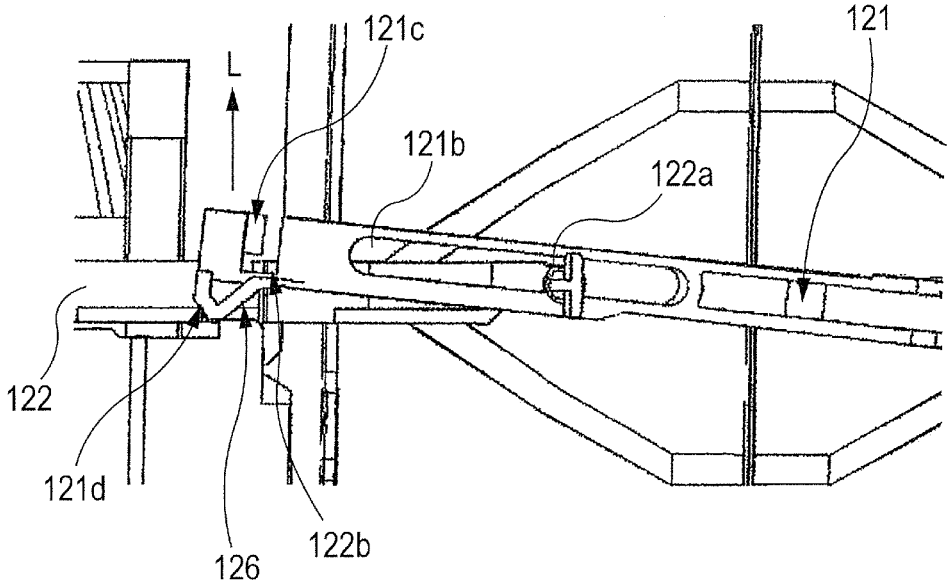
FIG. 19 is a diagram illustrating an operation of the open/close control member moving mechanism according to the first other configuration when removing a set toner bottle from the developer replenishment container accommodating apparatus.

As illustrated in FIG. 18, a protruded portion 121*d* is provided on a lower portion of the engaging protrusion 121*c* of the link member 121. A protruded portion 126 is provided on the accommodating apparatus 20. When pulling out the toner bottle 1, the replacement cover 103 is pivoted in the direction indicated by the arrow H as described above so that the link member 121 is moved in the direction indicated by the arrow K illustrated in FIG. 18. With the movement of the link member 121 in the direction indicated by the arrow K, the protruded portion 121*d* of the link member 121 is also moved in the direction indicated by the arrow K so that the protruded portion 121*d* interferes with the protruded portion 126. With this configuration, as illustrated in FIG. 19, the protruded portion 121*d* is pressed up in a direction indicated by the arrow L by the protruded portion 126 so that the engagement of the engaging protrusion 121*c* and the engaging protrusion 122*b* is released.

Figure 20:
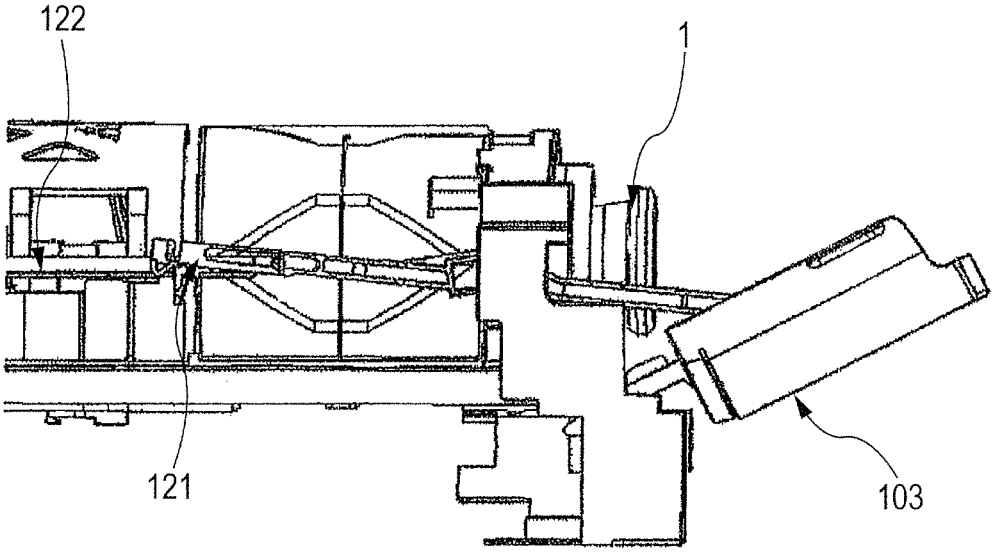
FIG. 20 is a diagram illustrating an operation of the open/close control member moving mechanism according to a second other configuration when removing a set toner bottle from the developer replenishment container accommodating apparatus.

A position of the protruded portion 126 is adjusted so that the sealing of the toner bottle 1 is completed by the sealing member opening/closing mechanism 115 at the same time as the release of the engagement of the engaging protrusion 121*c* and the engaging protrusion 122*b*. At this time, the replacement cover 103 is in the position illustrated in FIG. 20, and hence the toner bottle 1 cannot be pulled out yet so that the scattering of the toner due to the user's pulling out the toner bottle 1 before the toner bottle 1 is sealed can be prevented without fail. After that, when the engagement of the coupling member 122 and the link member 121 is released, the replacement cover 103 is opened up to the horizon as illustrated in FIG. 17B, and the user can pull out the toner bottle 1 in the direction indicated by the arrow E.

Figure 21:
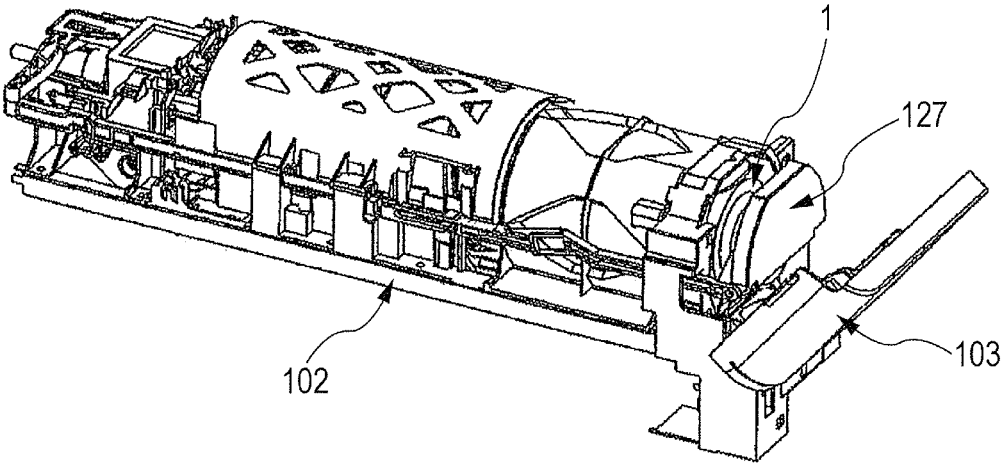
FIG. 21 is a diagram illustrating the second other configuration of the open/close control member moving mechanism.

A second other configuration of the open/close control member moving mechanism 102 will be described below. FIG. 21 is a diagram illustrating the second other configuration of the open/close control member moving mechanism 102. In FIG. 21, the same reference symbols as those in FIGS. 13A and 13B described above indicate the same or equivalent portions.

Figure 22:
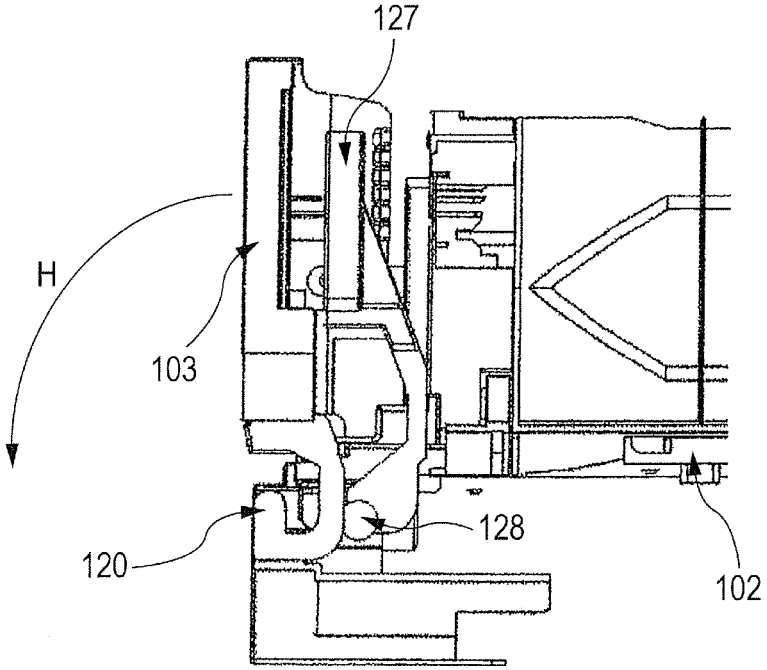
FIG. 22 is a diagram illustrating a state in which both a replacement cover and an inner door of the open/close control member moving mechanism are closed.

As illustrated in FIG. 21, an inner door 127 is provided to be sandwiched by the toner bottle 1 and the replacement cover 103. The inner door 127 is disposed in a position for blocking the pullout of the toner bottle 1 when the inner door 127 is closed. FIG. 22 is a diagram illustrating a state in which both the replacement cover 103 and the inner door 127 are closed.

Figure 23A:
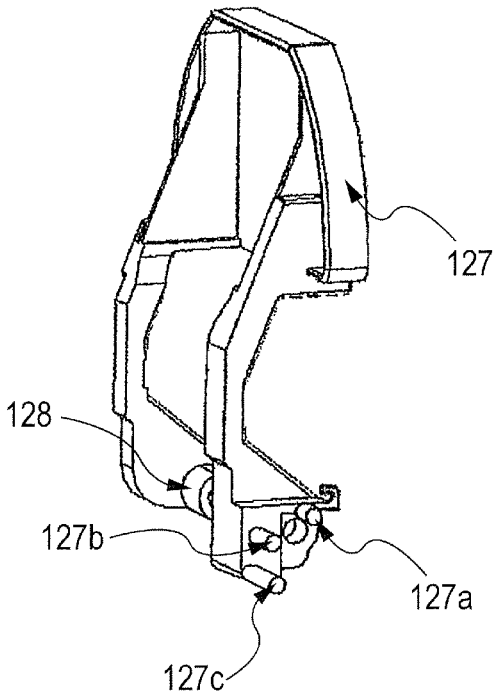
FIGS. 23A and 23B are diagrams illustrating configurations of the replacement cover and the inner door.
Figure 23B:
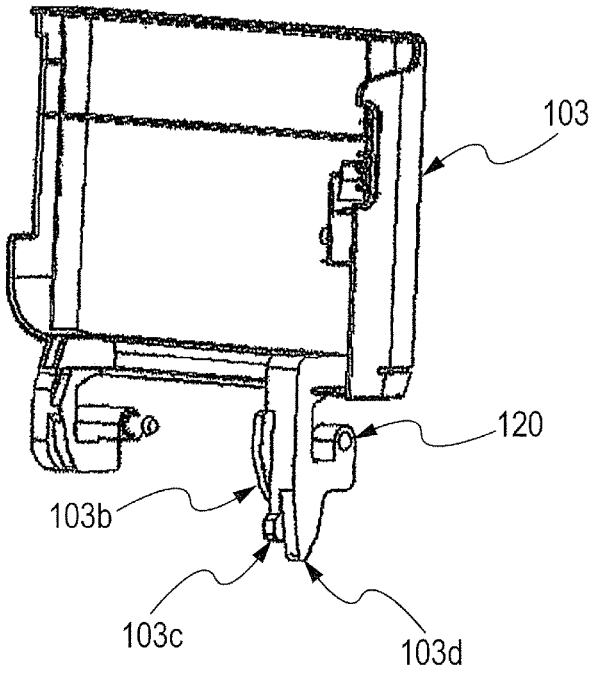

The inner door 127 is pivotable about a pivot shaft 128 which is parallel to the pivot shaft 120 of the replacement cover 103. The inner door 127 is pivotable in the direction indicated by the arrow H in the same manner as the replacement cover 103. Further, the inner door 127 is always biased in the direction indicated by the arrow H by a spring (now shown). In addition, as illustrated in FIG. 23A, the inner door 127 includes three (a plurality of) protruded portions 127*a*, 127*b*, and 127*c*, and as illustrated in FIG. 23B, the replacement cover 103 includes three cams 103*b*, 103*c*, and 103*d*.

Shapes and operations of the protruded portions 127*a* to 127*c* provided on the inner door 127 and the cams 103*b* to 103*d* provided on the replacement cover 103 will be described below. Normally, the inner door 127 is always biased in the direction indicated by the arrow H illustrated in FIG. 22, and therefore, the protruded portions 127*a* to 127*c* of the inner door 127 and the cams 103*b* to 103*d* of the replacement cover 103 always abut on each other, and the movement of the inner door 127 is controlled by the movement of the replacement cover 103.

Figure 24A:
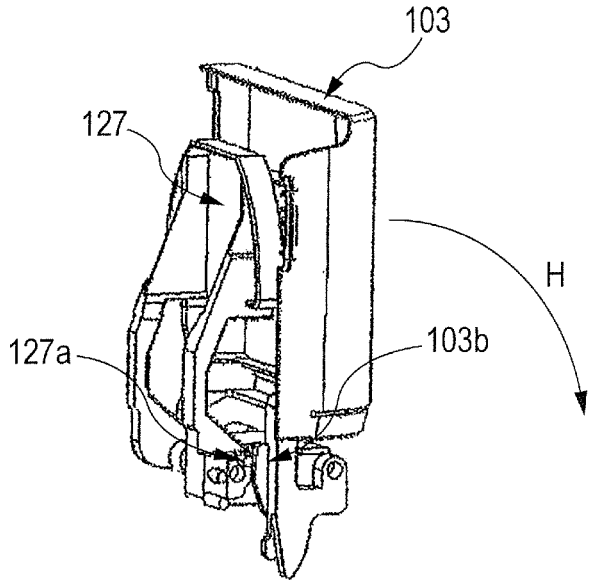
FIGS. 24A, 24B, and 24C are diagrams illustrating a state in which the replacement cover and the inner door are opened.

FIG. 24A illustrates a state in which the replacement cover 103 is completely closed (a position of 90 degrees when the horizon is 0 degrees). At this time, the protruded portion 127*a* of the inner door 127 which is biased toward the replacement cover 103 by a spring (not shown) abuts on the cam 103*b* of the replacement cover 103.

When the replacement cover 103 is completely closed, the replacement cover 103 is in the position of 90 degrees. In the position of 90 degrees, the replacement cover 103 is in a vertical state. When the replacement cover 103 is completely opened, the replacement cover 103 is in the position of 0 degrees. In the position of 0 degrees, the replacement cover 103 is in a horizontal state.

Figure 24B:
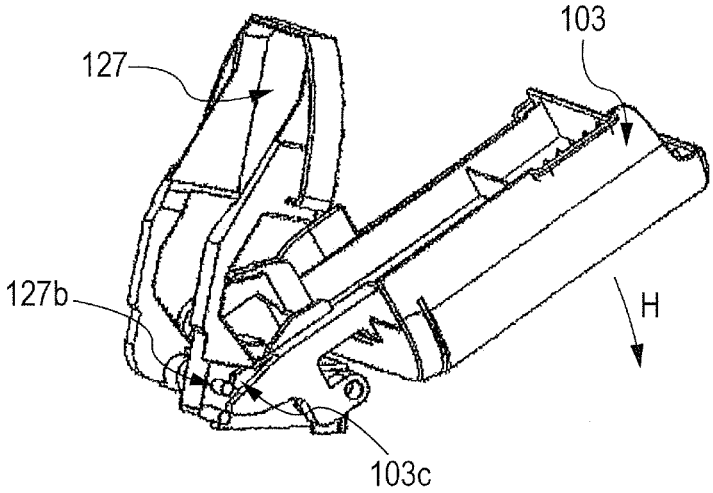

The cams 103*b* to 103*d* of the replacement cover 103 are formed so that only the replacement cover 103 is opened until the replacement cover 103 reaches a position of 30 degrees. Therefore, when the horizon is set to 0 degrees, until the replacement cover 103 is opened from the position of 90 degrees to the position of 30 degrees, as illustrated in FIG. 24B, the inner door 127 maintains the state of being closed.

Figure 24C:
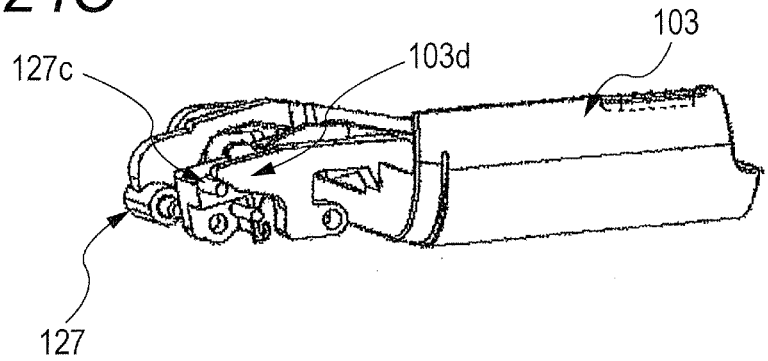

When the replacement cover 103 in this state is further opened in the direction indicated by the arrow H, the protruded portion 127*a* of the inner door 127 and the cam 103*b* of the replacement cover 103 are separated from each other, and instead, the protruded portion 127*b* and the cam 103*c* abut on each other. As a result, the inner door 127 starts to be opened in the direction indicated by the arrow H at an opening speed higher than that of the replacement cover 103. FIG. 24C illustrates a state in which the replacement cover 103 is completely opened. At this time, the inner door 127 is also opened up to the horizon (0 degrees) along with the replacement cover 103. The portions abutting on each other at this time are the protruded portion 127*c* and the cam 103*d*. Therefore, the inner door 127 is supported by the replacement cover 103, and is not opened any more.

Figure 25:
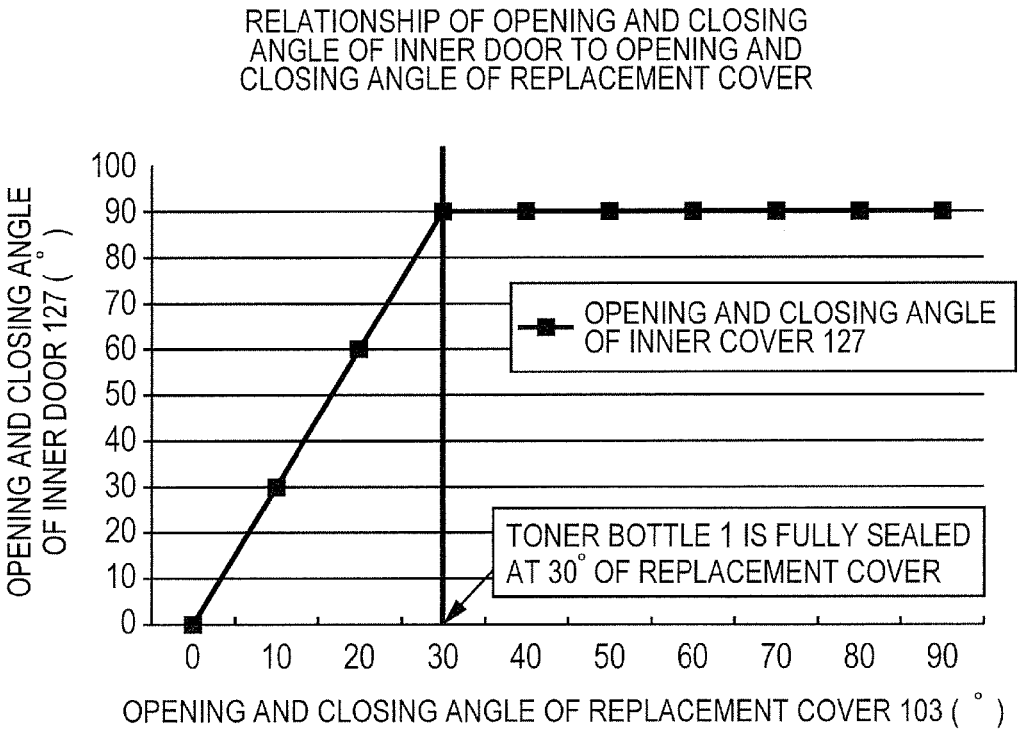
FIG. 25 is a graph showing a relationship between opening and closing angles of the replacement cover and the inner door.

FIG. 25 is a graph showing a relationship between opening and closing angles of the inner door 127 and the replacement cover 103. As shown in FIG. 25, the inner door 127 is not moved in a period in which the replacement cover 103 is opened from 90 degrees to 30 degrees. The inner door 127 is completely opened from 90 degrees to 0 degree in a period in which the replacement cover 103 is opened from 30 degrees to 0 degree. The toner bottle 1 is designed to be completely sealed when the replacement cover 103 is opened to 30 degrees.

In this manner, because the removal of the toner bottle 1 can be surely blocked by the inner door 127, the toner bottle 1 is not pulled out in a period in which the replacement cover 103 is opened from 90 degrees to 30 degrees. In addition, because the toner bottle 1 is completely sealed in a period in which the replacement cover 103 is between 0 degree and 30 degrees, the developer is not scattered due to the user's pulling out the toner bottle 1 in the period in which the replacement cover 103 is between 0 degree and 30 degrees.

When performing an operation of closing the replacement cover 103, the cam 103*d*, the cam 103*c*, and the cam 103*b* of the replacement cover 103 are sequentially brought into contact with the protruded portion 127*c*, the protruded portion 127*b*, and the protruded portion 127*a* of the inner door 127 in reverse order to the order at the time of opening the replacement cover 103. With this operation, the inner door 127 is completely raised to 90 degrees in a period in which the replacement cover 103 is raised from the horizon to 30 degrees.

Figure 26A:
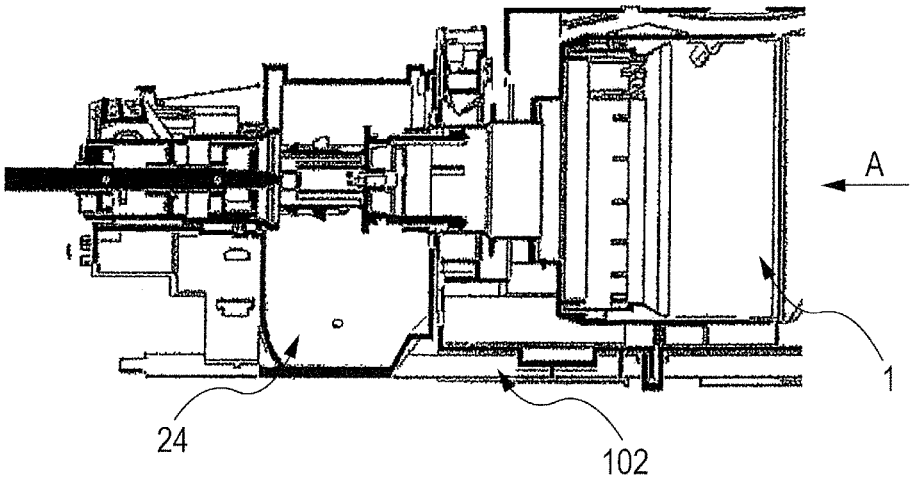
FIGS. 26A and 26B are diagrams illustrating an operation when closing the replacement cover.

With this operation, even when the toner bottle 1 is put in the accommodating apparatus 20 and is in the position illustrated in FIG. 26A in the state of not being set, a rear end portion of the toner bottle 1 is pushed in the direction indicated by the arrow A by the inner door 127. As a result, the toner bottle 1 is surely set, achieving the state illustrated in FIG. 26B.

Figure 26B:
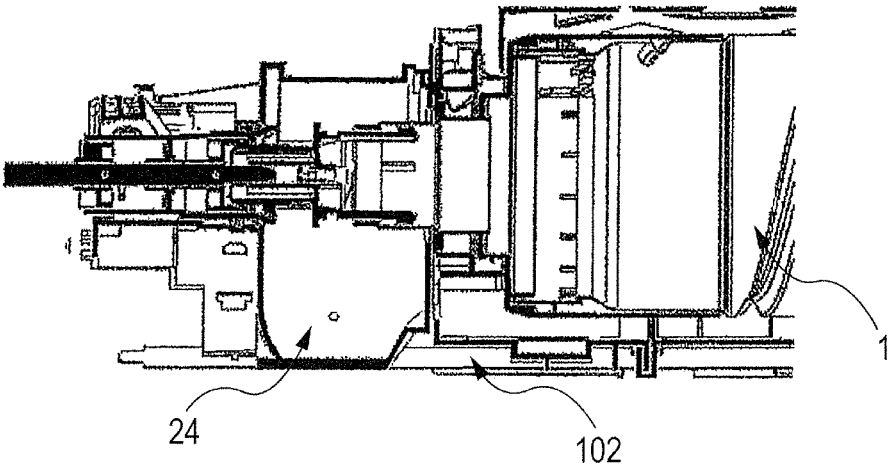
Figure 27:
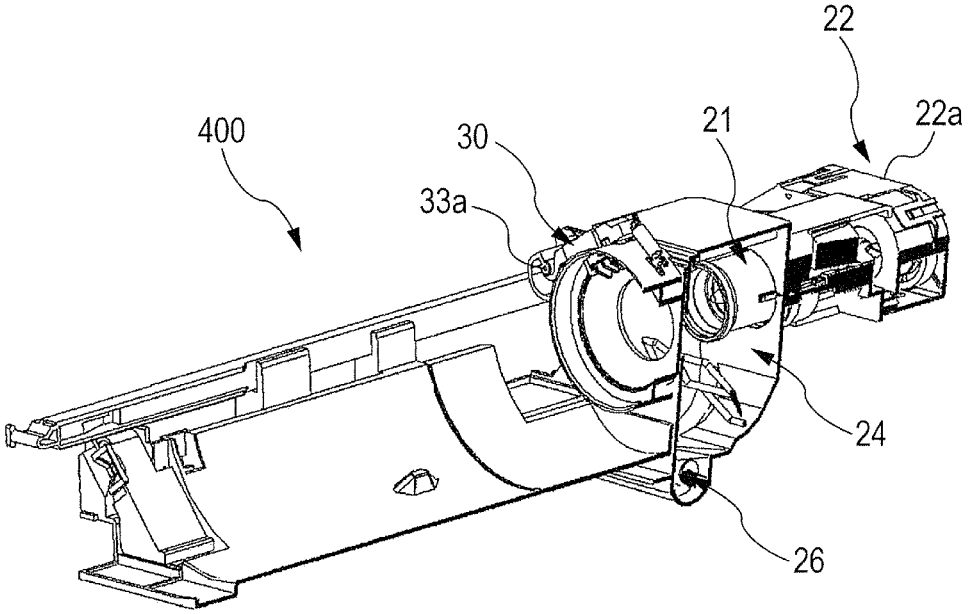
FIG. 27 is a perspective view of a conventional developer replenishment container accommodating apparatus.

In this manner, by providing the inner door 127, the toner bottle 1 can be set simply by closing the replacement cover 103, although an operation of closing the replacement cover 103 after setting the toner bottle 1 in a position in which the toner bottle 1 can be unsealed as illustrated in FIG. 26B is required in the conventional configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-276318, filed Dec. 16, 2011, which is hereby incorporated by reference herein in its entirety.

What is claimed is:

1. A developer replenishment container accommodating apparatus which receives a removable developer replenishment container and which replenishes a developer while rotating the developer replenishment container, the accommodating apparatus comprising:

a holding portion provided on a main body of the accommodating apparatus and configured to hold the developer replenishment container received in the main body in a replenishment position for replenishing the developer; and a pressing portion configured to press the developer replenishment container disposed in the main body in a direction opposite to a push-in direction in which the developer replenishment container is received, the pressing portion being provided upstream of the holding portion in the push-in direction, and the pressing portion pressing the developer replenishment container against the holding portion while the developer replenishment container is rotated.

2. The developer replenishment container accommodating apparatus according to claim 1, wherein the pressing portion is provided on a side opposite to the holding portion.

3. The developer replenishment container accommodating apparatus according to claim 1, wherein the pressing portion comprises:

an engaging piece configured to engage with the developer replenishment container when the developer replenishment container is moved in the push-in direction; and a biasing member configured to bias the engaging piece in the direction opposite to the push-in direction, wherein the engaging piece engages with the developer replenishment container before the developer replenishment container is held by the holding portion, and is moved together with the developer replenishment container against a biasing force of the biasing member.

4. The developer replenishment container accommodating apparatus according to claim 1, wherein the holding portion comprises a click portion configured to engage with the developer replenishment container; a holding member configured to hold the click portion; a support portion configured to support the holding member movable between an engaging position in which the click portion engages with the developer replenishment container and an engagement release position in which an engagement of the click portion and the developer replenishment container is released; and a biasing member configured to bias the holding member to position the holding member in the engaging position.

5. The developer replenishment container accommodating apparatus according to claim 3, wherein the holding portion comprises a click portion to engage with the developer replenishment container, and a movement distance of the engaging piece in the push-in direction is longer than a distance between the click portion and the engaging piece in the push-in direction.

6. The developer replenishment container accommodating apparatus according to claim 4, wherein the holding member is supported by the support portion so as to be pivotable in a direction orthogonal to the push-in direction, when the developer replenishment container is pulled out, the holding member is moved to the engagement release position after the click portion is pressed by the developer replenishment container so as to be pivoted by a predetermined amount.

7. The developer replenishment container accommodating apparatus according to claim 6, wherein a biasing force of the biasing member of the holding portion is larger than a biasing force of the click portion.

8. An image forming apparatus, comprising:

a developing portion configured to develop an electrostatic latent image with a developer; and per replenishment container accommodating apparatus according to claim 1.

9. A developer replenishment container detachably mountable to a main body of a developer replenishment container accommodating apparatus to replenish a developer, the main body of the accommodating apparatus including a projecting portion configured to determine a position of the developer replenishment container to discharge the developer with respect to the main body and a biasing portion configured to bias the developer replenishment container in a direction opposite to an inserted direction in which the developer replenishment container is inserted into the main body, the developer replenishment container comprising:

a container body configured to contain the developer and rotatable about an axis thereof, the container body being provided with an opening at one axial end portion thereof, the opening being configured to permit discharge of the developer contained in the container body;

an open/close member configured to open and close the opening;

an inserted portion into which the projecting portion is inserted, the inserted portion including a first surface portion disposed upstream of the opening in the inserted direction and configured to be engageable with the projecting portion and a second surface portion disposed opposite to the first surface portion in the inserted direction at a position upstream of the first surface portion in the inserted direction and configured to be engageable with the projecting portion; and a portion to be biased disposed upstream of the first surface portion in the inserted direction and configured to be biased in the direction opposite to the inserted direction by the biasing portion so that during rotation of the container body, the biasing portion causes the first surface portion to contact the projecting portion.

10. The developer replenishment container according to claim 9, wherein the first surface portion has a shape protruding from a surface of the container body.

11. The developer replenishment container according to claim 9, further comprising a sealing member provided at a side adjacent to the container body and configured to seal the opening when the sealing member and the container body are in a first position relative to one another, the opening becoming unsealed by a relative movement of the sealing member and the container body away from one another from the first position to a second position relative to one another.

12. The developer replenishment container according to claim 11, further comprising a feeding portion configured to feed the developer in the container body toward the opening by rotating the container body.

13. The developer replenishment container according to claim 9, wherein the portion to be biased is provided on a side opposite to the projecting portion.

14. The developer replenishment container according to claim 9, wherein the first surface portion is provided at a downstream end of the developer replenishment container in the direction in which the developer replenishment container is inserted into the main body, and the portion to be biased is biased so that the container body is rotated with the opening being inclined downward and the first surface portion is pressed against the projecting portion.

15. The developer replenishment container according to claim 9, wherein the portion to be biased is rotatable integrally with the first surface portion.

* * * * *